US011766769B2

(12) United States Patent
Krupey

(10) Patent No.: US 11,766,769 B2
(45) Date of Patent: Sep. 26, 2023

(54) BACKUP TOOLS

(71) Applicant: Gary Raymond Krupey, Fenton, MO (US)

(72) Inventor: Gary Raymond Krupey, Fenton, MO (US)

( * ) Notice: Subject to any disclaimer, the term of this patent is extended or adjusted under 35 U.S.C. 154(b) by 15 days.

(21) Appl. No.: 17/545,388

(22) Filed: Dec. 8, 2021

(65) Prior Publication Data

US 2022/0184780 A1 Jun. 16, 2022

Related U.S. Application Data

(60) Provisional application No. 63/125,477, filed on Dec. 15, 2020, provisional application No. 63/124,438, filed on Dec. 11, 2020.

(51) Int. Cl.
*B25B 23/00* (2006.01)
*B25B 13/06* (2006.01)

(52) U.S. Cl.
CPC ..... *B25B 23/0085* (2013.01); *B25B 13/065* (2013.01)

(58) Field of Classification Search
CPC ... B25B 23/0085; B25B 23/08; B25B 13/065; B25B 13/06; B25B 13/48; B25B 13/50
USPC ..... 81/462, 180.1, DIG. 8, 13
See application file for complete search history.

(56) References Cited

U.S. PATENT DOCUMENTS 601,146 A * 3/1898 Johnson ..... B25B 13/463 81/63
711,422 A * 10/1902 Greenlief ..... B25B 13/463 81/177.85
1,431,832 A 10/1922 Mills et al.
1,483,019 A * 2/1924 Smith ..... B25B 23/0085 81/55
5,429,465 A 7/1995 Puskas
5,954,466 A * 9/1999 Coffey ..... B25B 23/0085 81/13
2010/0288083 A1* 11/2010 Yu ..... B25B 13/481 81/185.2

(Continued)

FOREIGN PATENT DOCUMENTS

CA 3069334 A1 1/2019
GB 2478955 A 9/2011

(Continued)

OTHER PUBLICATIONS

LTR Catalog, LTR Backup Wrench, wwwtorcup.com, 2020; 2 pages.

(Continued)

*Primary Examiner* — Brian D Keller
*Assistant Examiner* — Abbie E Quann
(74) *Attorney, Agent, or Firm* — Harness, Dickey & Pierce, P.L.C.; Anthony G. Fussner

(57) ABSTRACT

Exemplary embodiments are disclosed of backup tools. In an exemplary embodiment, a backup tool generally includes a socket configured for receiving a nut of a flanged connection; a release nut; and an arm extending generally between the socket and the release nut. The arm defines a reaction surface configured to abut against at least a portion of the flanged connection for holding the nut against rotation when a bolt or another nut on a stud is being rotated relative to the nut within the socket of the backup tool, to thereby tighten the flanged connection.

21 Claims, 26 Drawing Sheets

(56) References Cited

U.S. PATENT DOCUMENTS

2012/0000319 A1 1/2012 Armstrong et al.

FOREIGN PATENT DOCUMENTS

WO WO-02101249 A1 * 12/2002 ..... B25B 23/00
WO WO-11100256 A1 8/2011

OTHER PUBLICATIONS

TBW Catalog, TBW Backup Wrench, www.torcup.com, 2017, 2 pages.
Piper Backup Wrench + A & W Devices, Inc., https://a-w-devices,com/piper-backup-wrench/, Nov. 16, 2020, 6 pages.
New Torque Wrench back-Up Spanners/Enerpac, https://www.enerpac.com/en-us/news/new-product/new-torque-wrench-back-up-spanners, Nov. 16, 2020, 3 pages.
Lokrite Backup Wrench—SMP Tools, https://wmptools.com/lokrite-backup-wrench/, Nov. 16, 2020, 11 pages.
Industrial Bolting Piping Backup Wrench, accessed Nov. 16, 2020, 1 page.
The Safe Solution for flogging spanner challenges, https://www.linkedin.com/pulse/safe-solution-flogging-spanner-challenges-georgie-arnold/, Nov. 16, 2020, 5 pages.
Backup Wrenches, www.industrialtorquetools.com/backup-wrenches/, Nov. 16, 2020, 4 pages.
Slogging Spanners Flat Ring, Open End and Offset Ring, https://torquewarehouse.com.au/slogging-spanners/?doing_wp_cron=1605488849.8529200553894042968750, Nov. 16, 2020, 17 pages.
Williams 1188 Super Torque Combination Wrench, 1-7/8 Inch; Amazon.com, Copyright 1996-2021, 8 pages.

* cited by examiner

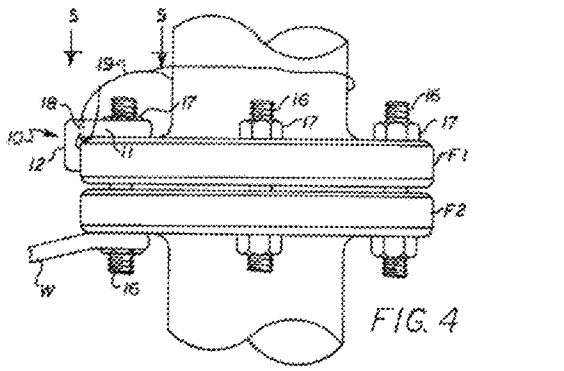
FIG. 4
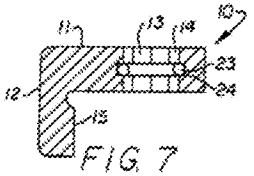
FIG. 7
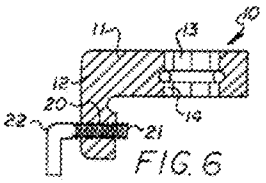
FIG. 6
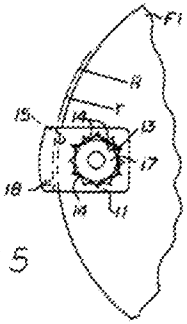
FIG. 5
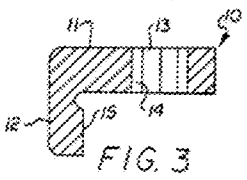
FIG. 3
FIG. 2
(Prior Art)
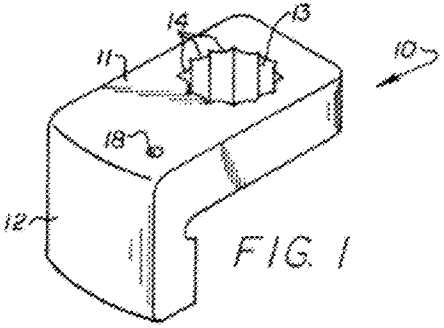
FIG. 1
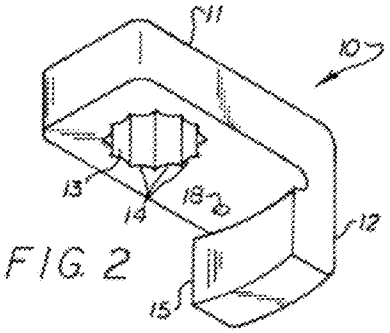
FIG. 2

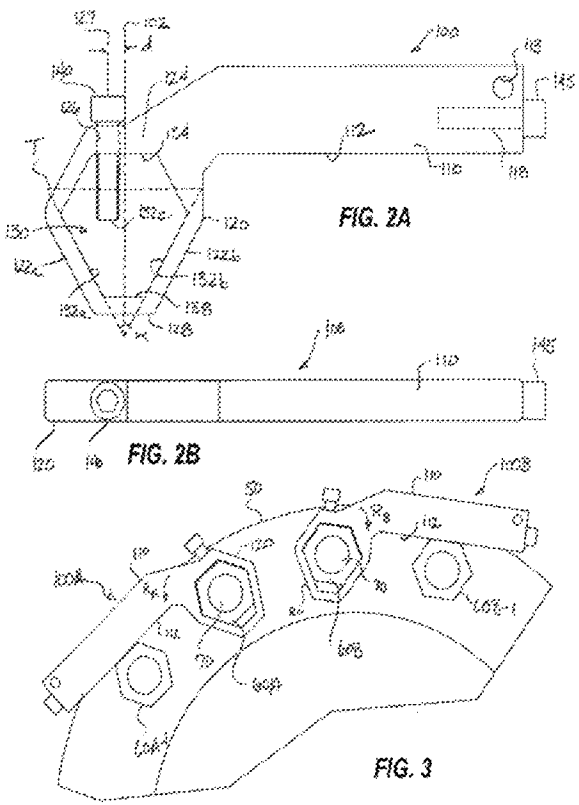
FIG. 2A
FIG. 2B
FIG. 3
FIG. 3
(Prior Art)
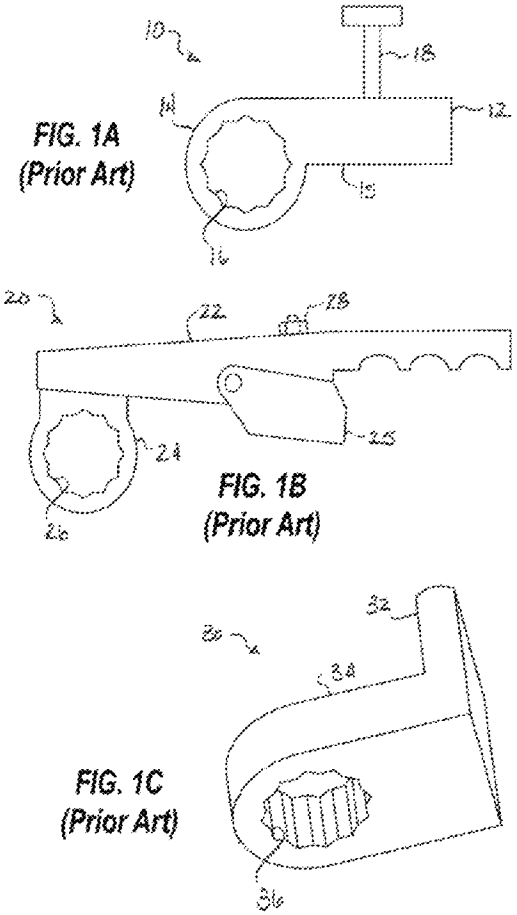
FIG. 1A
(Prior Art)
FIG. 1B
(Prior Art)
FIG. 1C
(Prior Art)

| NUT SIZE | STUD SIZE | PIPE SIZE | DIMENSION A | B | C | D | E | F | G | H | I | J | K | L | M | N | O |
|---|---|---|---|---|---|---|---|---|---|---|---|---|---|---|---|---|---|
| 7/8" | 1/2" | 1/2" | .500<br>1/2" | .437<br>7/16" | .625<br>5/8" | .885 | 1.187<br>1-3/16" | .500<br>1/2" | 3.219<br>3-7/32" | .844<br>27/32" | .719<br>23/32" | .072 | 1.875<br>1-7/8" | .870<br>7/8" | 1.022 | .920 | 1/2 |
| 11/16"<br>27mm | 5/8" | 3/4-2" | .625<br>5/8" | .531<br>17/32" | .750<br>3/4" | 1.072 | 1.430<br>1-7/16" | .593<br>19/32" | 3.922<br>3-59/64" | .937<br>15/16" | .797<br>51/64" | .109<br>7/64" | 2.392<br>2-25/64" | 1-1/16" | 1.235 | 1.115 | 5/8 |
| 1 1/4"<br>32mm | 3/4" | 1 1/2-6" | .750<br>3/4" | .625<br>5/8" | .875<br>7/8" | 1.264 | 1.688<br>1-11/16" | .750<br>3/4" | 5.099<br>5-7/64" | 1.062<br>1-1/16" | .906<br>29/32" | .109<br>7/64" | 3.287<br>3-19/64" | 1-1/4" | 1.456 | 1.310 | 5/8 |
| 1 7/16"<br>36mm | 7/8" | 8" | .875<br>7/8" | .656<br>21/32 | 1.00<br>1" | 1.455 | 1.930<br>1-15/16" | .859<br>55/64" | 5.910<br>5-59/64" | 1.093<br>1-3/32" | .937<br>15/16" | .109<br>7/64" | 3.958<br>3-61/64" | 1 7/16" | 1.660 | 1.503 | 11/16 |
| 1 5/8"<br>40mm | 1" | 10" | 1.00<br>1" | .750<br>3/4" | 1.125<br>1-1/8:" | 1.645 | 2.234<br>1-15/64" | .953<br>61/64" | 6.733<br>6-47/64" | 1.437<br>1-7/16" | 1.250<br>1-1/4" | .109<br>7/64" | 4.343<br>4-11/32" | 1 5/8" | 1.887 | 1.704 | 3/4 |
| 1 13/16"<br>46mm | 1 1/8 | 12-14" | 1.125<br>1 1/8" | .750<br>3/4" | 1.250<br>1-1/4" | 1.832 | 2.500<br>2-1/2" | 1.109<br>1-7/64" | 7.999<br>8" | 1.453<br>1-29/64" | 1.250<br>1-1/4" | .109<br>7/64" | 5.437<br>5-7/16" | 1 13/16" | 2.106 | 1.896 | 3/4 |
| 1 7/8"<br>47mm | 1 1/4 | 16-20" | Hollow<br>1 1/8" | .750<br>3/4" | 1.375<br>1-3/8" | 1.895 | 2.578<br>2-37/64" | 1.109<br>1-7/64" | 8.264<br>8-17/64" | 1.468<br>1-15/32" | 1.265<br>1-17/64" | .109<br>7/64" | 5.687<br>5-11/16" | 1 7/8" | 2.173 | 1.980 | 3/4 |
| 2"<br>50mm | 1 1/4 | 16-20" | Hollow<br>1 1/8" | .812<br>13/16" | 1.375<br>1-3/8" | 2.020 | 2.687<br>2-11/16" | 1.250<br>1-1/4" | 8.811<br>8-13/16" | 1.468<br>1-15/32" | 1.265<br>1-17/64" | .109<br>7/64" | 6.093<br>6-3/32" | 2" | 2.328 | 2.104 | 13/16 |
| 2 1/8"<br>55mm | 1 3/8 | 30" | Hollow<br>1 1/8" | .875<br>7/8" | 1.500<br>1-1/2" | 2.150 | 2.938<br>2-15/16" | 1.328<br>1-21/64" | 10.843<br>10-27/32" | 1.578<br>1-37/64" | 1.375<br>1-3/8" | .109<br>7/64" | 7.937<br>7-15/16" | 2-1/8" | 2.474 | 2.245 | 13/16 |
| 2 3/16"<br>56mm | 1 3/8 | 30" | Hollow<br>1 1/8" | .875<br>7/8" | 1.500<br>1-1/2" | 2.211 | 2.890<br>2-57/64" | 1.328<br>1-21/64" | 10.906<br>10-29/32" | 1.641<br>1-41/64" | 1.438<br>1-7/16" | .109<br>7/64" | 7.937<br>7-15/16" | 2-3/16" | 2.544 | 2.307 | 13/16 |
| 2 1/4"<br>58mm | 1 1/2 | 24" | Hollow<br>1 1/4" | 1.218<br>1-7/32" | 1.625<br>1-5/8" | 2.274 | 3.140<br>3-9/64" | 1.328<br>1-21/64" | 9.844<br>9-27/32" | 1.641<br>1-41/64" | 1.438<br>1-7/16" | .109<br>7/64" | 6.875<br>6-7/8 | 2-1/4" | 2.601 | 2.365 | 7/8 |
| 2 3/8"<br>60mm | 1 1/2 | 24" | Hollow<br>1 1/4" | 1.218<br>1-7/32" | 1.625<br>1-5/8" | 2.386 | 3.140<br>3-9/64" | 1.500<br>1-1/2" | 10.109<br>10-7/64" | 1.734<br>1-47/64" | 1.531<br>1-17/32" | .109<br>7/64" | 6.875<br>6-7/8 | 2 3/16" | 2.734 | 2.490 | 7/8 |

FIG. 17

BACKUP TOOLS

CROSS-REFERENCE TO RELATED APPLICATIONS

This application claims the benefit of and priority to U.S. Provisional Patent Application No. 63/124,438 filed Dec. 11, 2020 and U.S. Provisional Patent Application No. 63/125,477 filed Dec. 15, 2020. The entire disclosures of the above applications are incorporated herein by reference.

FIELD

The present disclosure generally relates to backup tools, e.g., pipe flange backup socket wrenches, etc.

BACKGROUND

This section provides background information related to the present disclosure which is not necessarily prior art.

It is common for backup tools to be used to hold a first nut in place on a flanged connection while tightening or loosening a bolt or a second nut on a stud. The backup tool fits on the first nut and prevents the first from rotating on the bolt when the second nut is being torqued or loosened.

For example, FIG. 1 includes FIGS. 1 and 2 from U.S. Pat. No. 1,431,832 illustrating a nut holder 1. The nut holder 1 includes a socket 2 that is placed on a nut 5 of a bolt along a first side of a flange 6. The nut holder 1 includes a horizontally/laterally extending lever portion 3 having an extremity 4 that rests against an adjacent nut 5 of another bolt to prevent rotation of the nut holder 1 and therefore the nut 5 on which the socket 2 is placed. An operator can apply a very small tightening torque of about 30 feet pounds to the opposite end of the bolt on the second side of the flange 2. But the extremity 4 of the horizontally/laterally extending lever portion 3 will miss the nut 5 when the nut holder is rotated. Also, flanges have different bolt hole patterns such that the operator would need numerous nut holders with lever portions 3 of different lengths.

As another example, FIG. 2 includes FIGS. 1-6 from expired U.S. Pat. No. 5,954,466 illustrating conventional generally L-shaped anti-rotation clips 10 for preventing rotation of a nut-like member (nut or bolt head) of a flanged connection F1, F2 to facilitate tightening or loosening of the nut-like member and eliminate the need to use two wrenches for tightening or loosening a nut or bolt. The clip 10 is a generally L-shaped member having a horizontal portion 11 and a vertical portion 12 at one end thereof extending generally perpendicular thereto. A polygonal opening 13 extending vertically through the horizontal portion 11 has a plurality of discrete angled sides 14 configured to surround and engage the sides of the nut-like member 17. The inner surface of the vertically portion 12 is spaced a distance from the opening and is received on the outer surface of a flange with which the nut-like member is associated to prevent rotation of the surrounded nut-like member while torque is applied to a vertically opposed bolt head or nut connected with the surrounded nut-like member such that the nut-like member is prevented from rotating as torque is continued to tighten or loosen the connected nut-like member relative to the opposed bolt head or nut.

As further examples, FIG. 3 includes FIGS. 1-3 from abandoned U.S. Patent Application Publication US2012/0000319 illustrating conventional backup tools 10, 20, 30, and 100 for holding nuts against rotation. The backup tool 10 (FIG. 1A) has a wrench 14 with an arm 12 extending therefrom. The wrench 14 defines a socket 16 for engaging a hex nut. An inside reaction surface 15 of the arm 12 fits against an adjacent nut when the tool 10 is fitted on the nut to be held. An adjustment screw 18 passes through the arm 12 for adjusting the support provided by the reaction surface 15 depending on how the socket 16 fits on its nut and how the arm 12 extends relative to the adjacent nut. But as recognized herein, the adjustment screw 18 would not be removable by hand without using another wrench to loosen the screw 18 which also takes up a lot of room.

The backup tool 20 (FIG. 1B) has a wrench 24 defining a socket 26 for engaging a nut. An arm 22 extends horizontally/laterally from the wrench 24. The arm 22 has a pivotally attached reaction lever 25 for fitting against an adjacent nut. An adjustment screw 28 passes through the arm 22 for adjusting position of the reaction lever 25 as needed.

The backup tool 30 (FIG. 1C) has a short toe 32 connected to a wrench 34 defining a socket 36. The socket 36 fits on a hex nut. The short toe 32 extends parallel along a portion of a length of a bolt on which this nut is positioned so that the short toe 32 fits against an edge portion of a flange 50.

The backup tool 100 (FIGS. 2A-2B) has an arm 110 and a wrench 120. The wrench 120 has a socket 130 for engaging nuts such that the backup tool 100 can hold the nut when another nut on the bolt is tightened or loosened with an impact wrench. The arm 110 supports the wrench 120 from rotation when the tool 100 is disposed on the hex nut. A screw 140 can be used to adjust the size of hex nut that can be held in the socket 130. In use, an operator positions the socket 130 of the tool 100 on the nut 60 and tightens the adjustment screw 140. The nut 60 and tool 100 can then be rotated until the reaction surface 112 engages an adjacent nut, stopping rotation. The operator may loosen the adjustment screw 140 to release the nut 60. But as recognized herein, another wrench would be necessary to loosen the screw 140, which takes up a lot of room. Also, the arm 110 would not land flat against the adjacent nut.

DRAWINGS

The drawings described herein are for illustrative purposes only of selected embodiments and not all possible implementations and are not intended to limit the scope of the present disclosure.

FIG. 1 includes FIGS. 1 and 2 from expired U.S. Pat. No. 1,431,832 illustrating a conventional backup tool for holding a nut against rotation.

FIG. 2 includes FIGS. 1-6 from expired U.S. Pat. No. 5,954,466 illustrating conventional generally L-shaped anti-rotation clips for preventing rotation of a nut-like member (nut or bolt head) of a flanged connection to facilitate tightening or loosening of the nut-like member and eliminate the need to use two wrenches for tightening or loosening a nut or bolt.

FIG. 3 includes FIGS. 1-3 from abandoned U.S. Patent Application Publication US2012/0000319 illustrating conventional backup tools for holding nuts against rotation.

FIGS. 4-8 show a backup tool according to exemplary embodiments of the present disclosure.

FIG. 9 generally shows the relative sizing of an exemplary embodiment of a backup tool along with a conventional backup wrench and an adult size pair of sunglasses.

Figure 16:
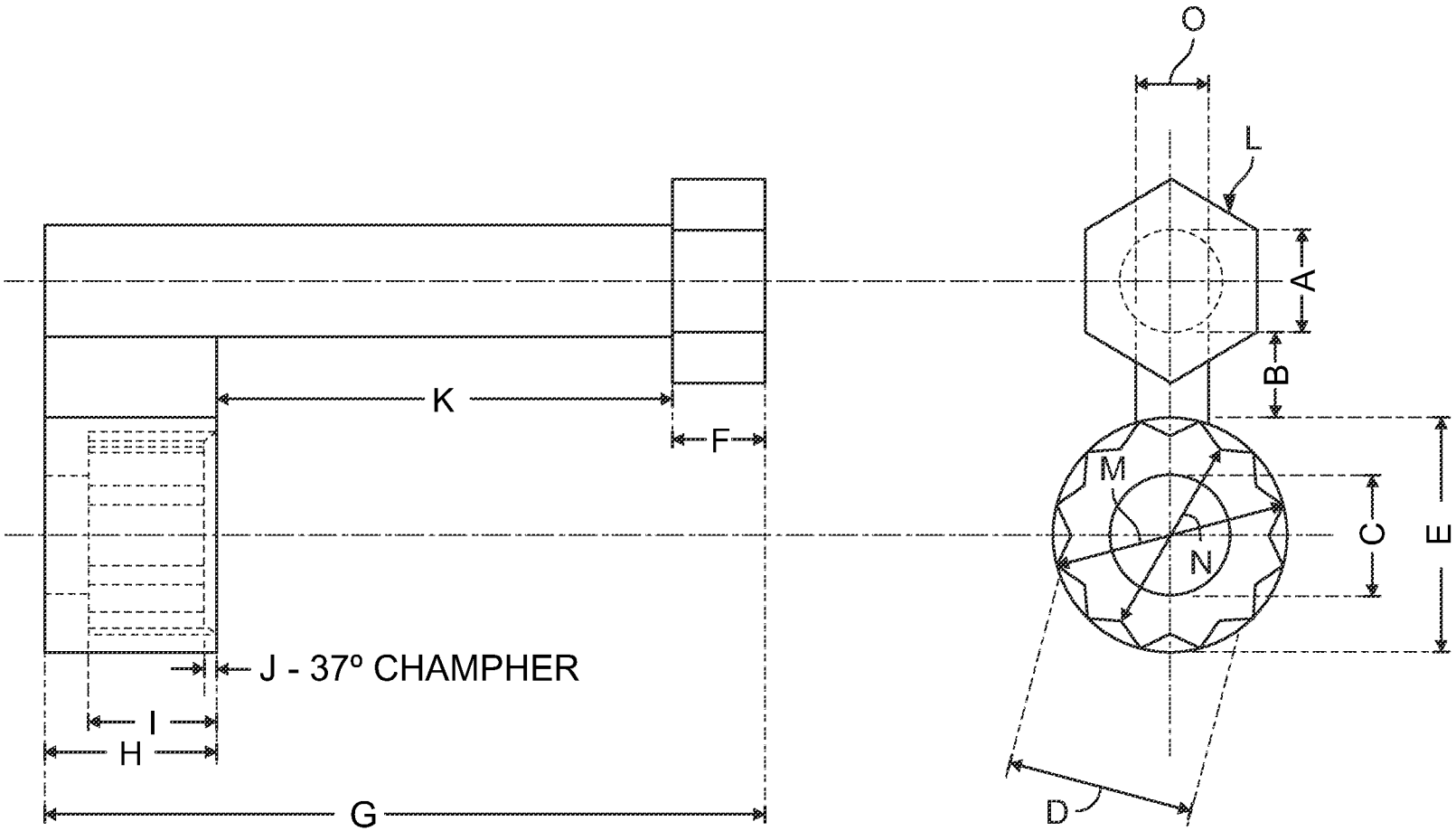
Figure 18A:
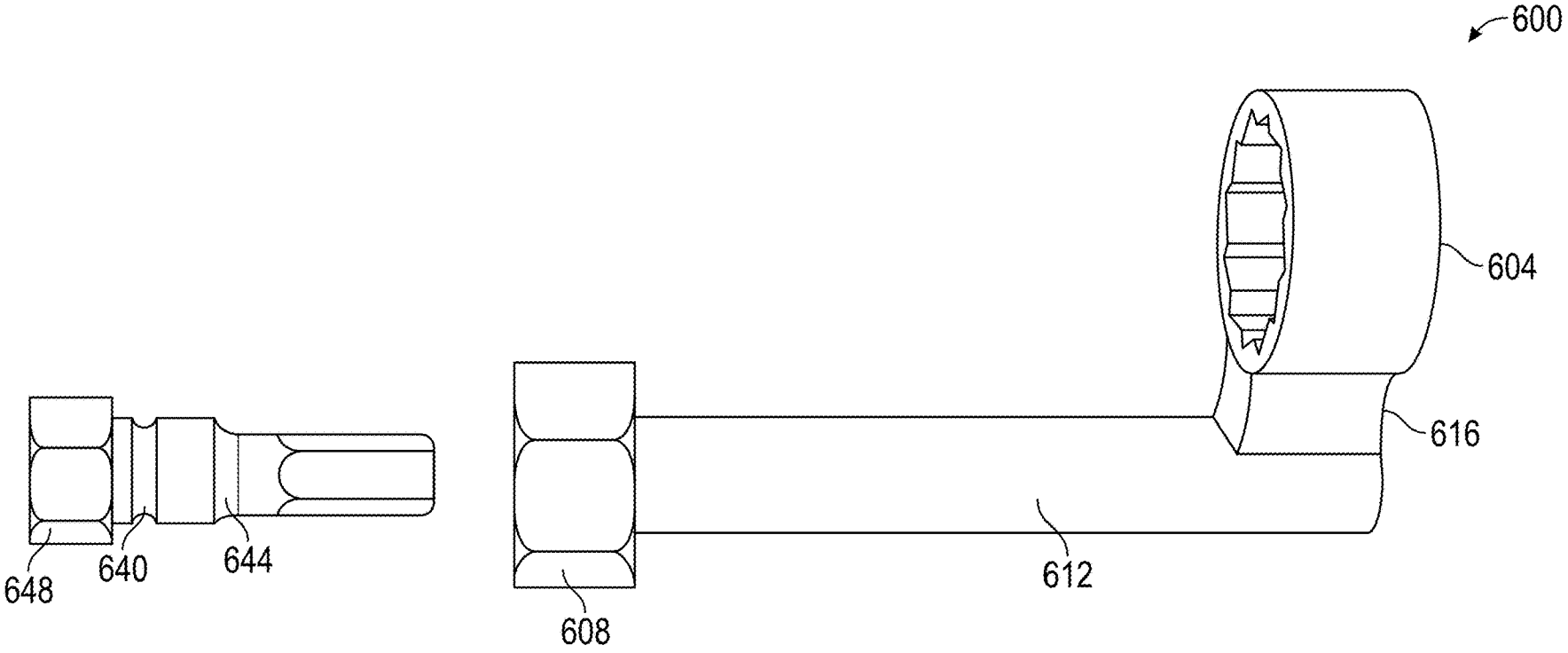
Figure 18B:
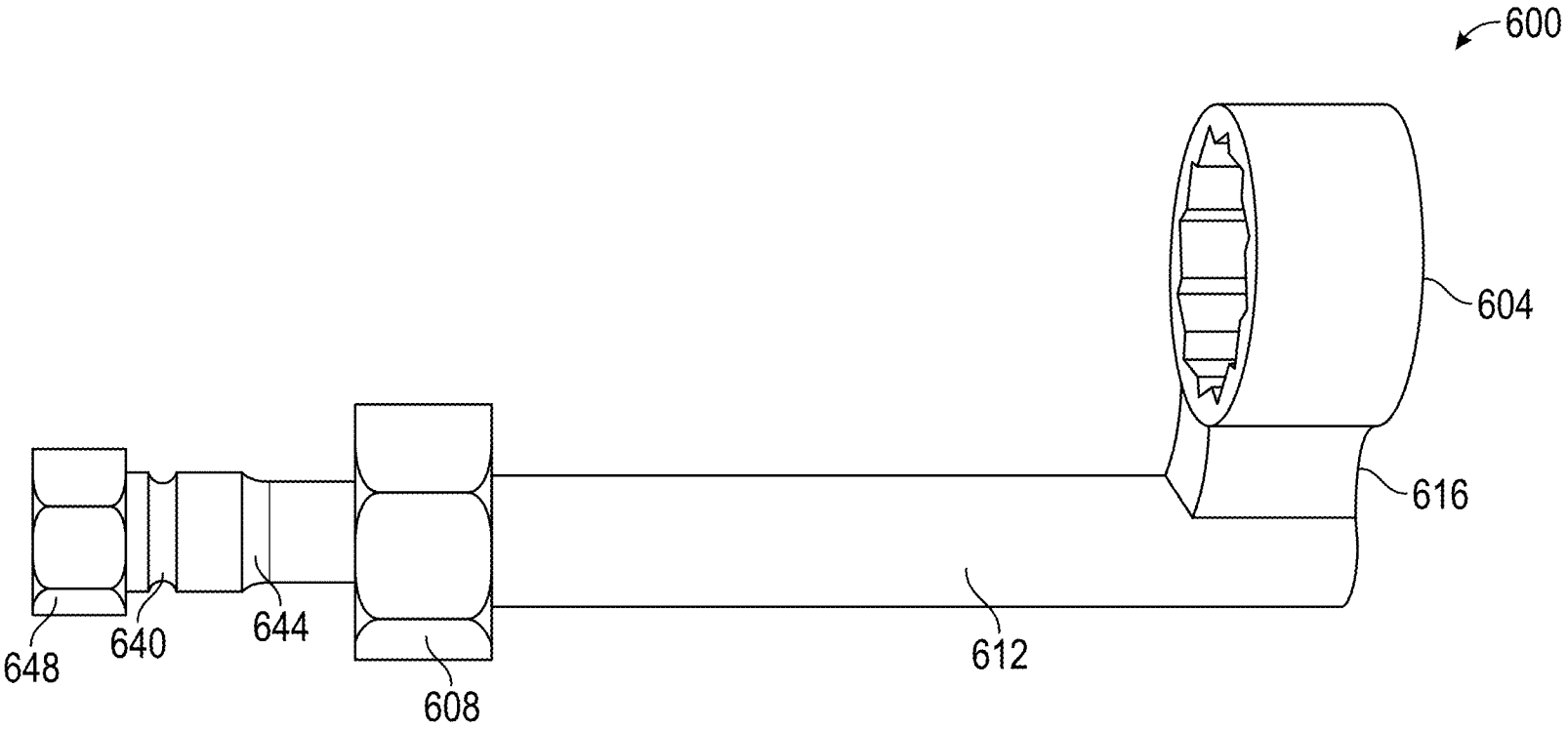
Figure 19:
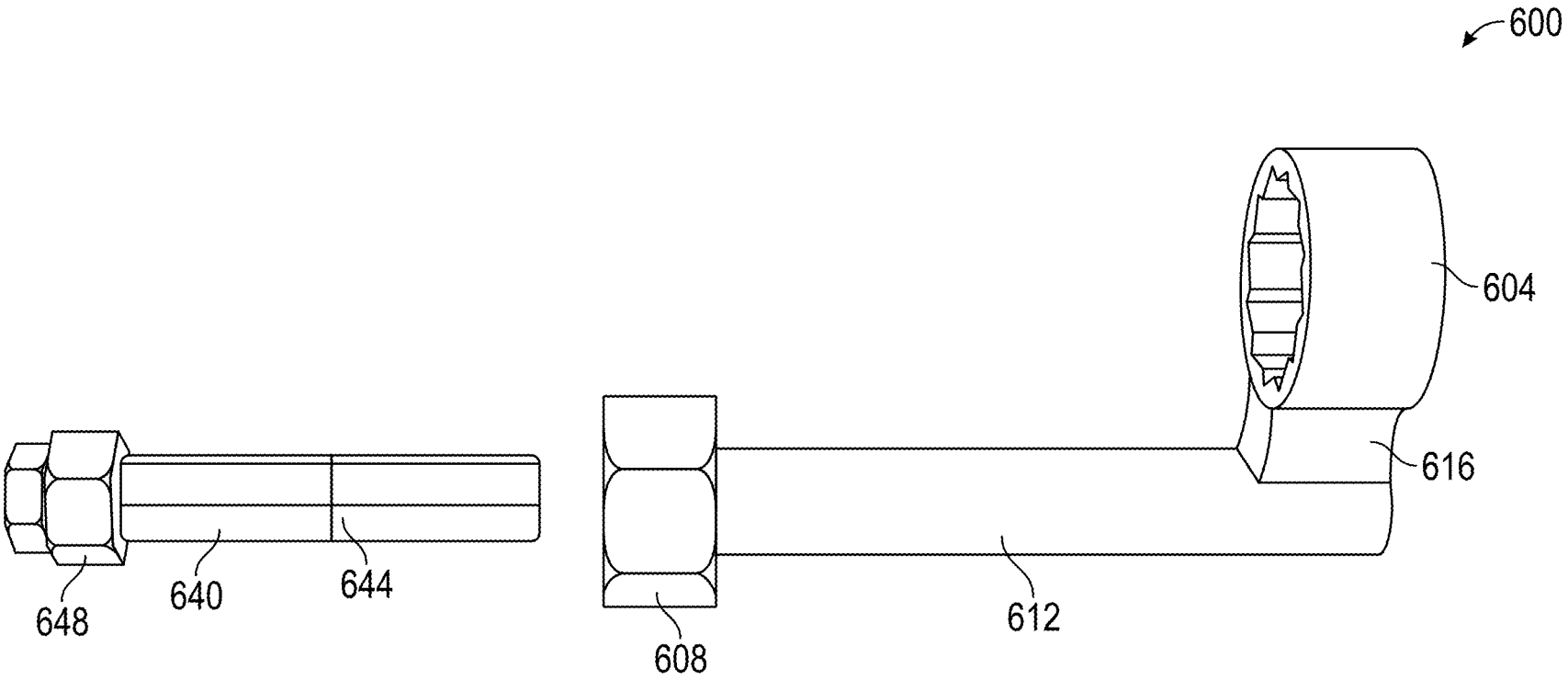

FIGS. 16 and 17 provide example dimensions that may be used for backup tools according to exemplary embodiments of the present disclosure.

FIGS. 18A, 18B, 19, and 20 show example drive members or drivers that may be used with backup tools according to exemplary embodiments of the present disclosure.

Figure 21:
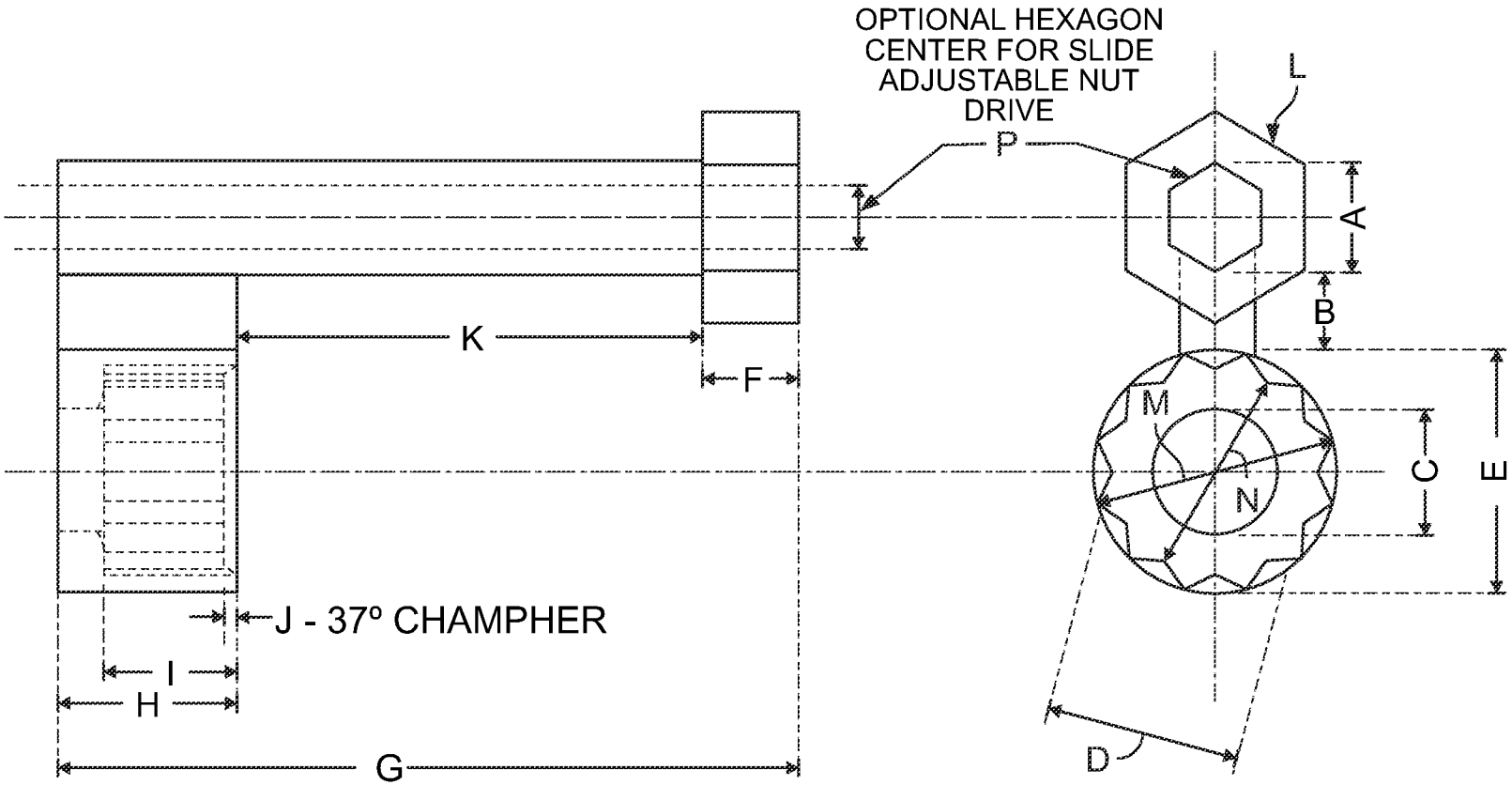

FIG. 21 and the table in FIG. 17 provide example dimensions that may be used for backup tools according to exemplary embodiments of the present disclosure.

FIGS. 22-35 show an exemplary embodiment of a backup tool being used with differently configured flanged connections in different locations, including very tight locations, locations with height restrictions, and/or locations with obstructions.

Corresponding reference numbers may indicate corresponding (but not necessarily identical) parts throughout 4-35.

DETAILED DESCRIPTION

Example embodiments will now be described more fully with reference to the accompanying drawings.

Figure 1:
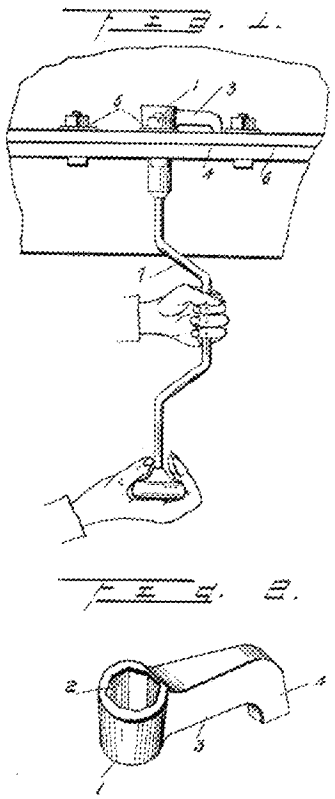
FIG. 1 (Prior Art)

The conventional backup tools illustrated in FIGS. 1-3 may be generally useful. But after recognizing significant drawbacks with conventional backup tools, the inventor hereof developed and discloses herein exemplary embodiments of backup tools. The inventor's backup tools may be configured to provide one or more (but not necessarily any or all) of the following advantage(s) over some conventional backup tools.

Exemplary embodiments of the backup tools disclosed herein may allow for a faster process in the placement of the backup tool onto a nut and removal of the backup tool from a nut, e.g., without requiring the tightening or loosening of an adjustment screw for engaging or disengaging the nut and/or without requiring the tightening or loosening of an adjustment screw to adjust or reposition the backup tool's reaction surface relative to an adjacent nut.

Exemplary embodiments of the backup tools disclosed herein may eliminate the need for two operators using two wrenches on opposite sides of a flanged connection. In exemplary embodiments, a single operator may install a backup tool onto a nut and then use another tool (e.g., impact wrench, etc.) to rotate to the bolt relative to the nut to thereby tighten or loosen the bolted flange connection. And, the backup tool will remain in place "hands free", e.g., while the backup tool's socket remains engaged with the nut and the backup tool's reaction surface remains engaged against a portion (e.g., flange sidewall, adjacent nut, etc.) of the flange connection (e.g., pressure boundary bolted joint, pipe flange, etc.) without requiring the single operator or another operator to manually hang onto the backup tool while rotating the bolt relative to the nut.

In the above example, the backup tool is described as being used with a bolted flange connection in which a shank of the bolt extends through aligned bolt holes of the mating flanges of the flanged connection. The bolt may include a polygonal (e.g., hexagonal, etc.) bolt head at one end portion of the shank, and a polygonal (e.g., hexagonal, etc.) nut threadedly engaged on an opposite threaded end portion of the shank. The backup tool may be installed onto the nut, and another tool (e.g., impact wrench with a polygonal socket, etc.) may be used to rotate the polygonal bolt head relative to the nut to thereby tighten the bolted flange connection while the backup tool holds the nut against rotation. But the backup tool may also be installed onto the polygonal bolt head and another tool may be used to rotate the nut relative to the bolt to thereby tighten the bolted flange connection while the backup tool holds the bolt against rotation.

In addition, the exemplary embodiments of the backup tools disclosed herein may also be used with other flange connections including studded flange connections in which studs or rods having threaded ends extend through the aligned bolt holes of the mating flanges, and nuts are threadedly engaged on the threaded ends of the studs or rods. In which case, the backup tool may be installed onto a first nut on a first threaded end portion of a stud/rod along a first side of the studded flange connection. And, another or second tool may be used to rotate a second nut on the second opposite threaded end portion of the stud/rod along a second opposite side of the studded flange connection while the backup tool holds the first nut against rotation. The studded flange connection may thus be tightened by the rotation of the second nut via the second tool relative to the first nut, which is prevented from rotating along with the second nut by the backup tool.

In exemplary embodiments, the socket of the backup tool may be configured (e.g., have sufficient length, include an opening, etc.) to accommodate for the length of the threaded end portion of the bolt, stud, or rod that extends beyond the nut on which the socket is placed. For example, the socket may include an opening through which the threaded end portion of the bolt, stud, or rod may extend when the socket is placed on and/or used to prevent rotation of the nut.

Exemplary embodiments of the backup tools disclosed herein may eliminate the need for an operator to walk around to an opposite second side of a flange to hang a backup tool on a nut on the opposite second side. In exemplary embodiments, the backup tool includes an arm defining a reaction surface where the arm is long enough to extend entirely across a flanged connection from the first side to the opposite second side. This, in turn, allows an operator to engage the socket of the backup tool (e.g., FIGS. 23, 24, and 25, etc.) with a nut along the opposite second side of the flanged connection while the operator remains on the first side of the flange connection (e.g., including flanges that have very large diameters of 6 feet, 12 feet, 20 feet or more, etc.).

In exemplary embodiments, the backup tool includes a release nut (broadly, a releaser or unlocker) and a socket for the nut of the flanged connection where the release nut and the socket have a same configuration (e.g., same size, same polygonal shape, etc.). Accordingly, the same single tool (e.g., impact wrench, etc.) may fit both the release nut of the backup tool and the nut of the flanged connection, thereby allowing the operator to take only that one tool on a jobsite.

For example, a socket of an impact wrench (e.g., battery-operated impact wrench, air-operated impact wrench, hydraulic tool, large hand ratchet, other tool, etc.) may be sized for receiving the head of a bolt of the flanged connection and for receiving the release nut of the backup tool. In this example, the socket of the impact wrench may be placed onto the head of the bolt, and the bolt may be rotated (e.g., clockwise) using the impact wrench after the socket of the backup tool has been placed onto a nut of the bolt to hold the nut against rotation when the reaction surface of the backup tool abuts against at least a portion of the flanged connection (e.g., flange sidewall, adjacent nut, etc.). After the bolt has been rotated to tighten the flanged connection, the socket of the impact wrench may be removed from the bolt head and placed onto the release nut of the backup tool. The impact wrench may then be used to rotate (e.g., counterclockwise) and apply torque to the release nut in an opposite, counter-rotational direction in which the bolt was rotated to tighten the flanged connection. This counter-rotation of the release nut releases the backup tool's reaction surface while also further tightening the flanged connection between the bolt and nut from the opposite second side. This further tightening of the flanged connection may be especially important as releasing pressure on a metal gasket after it has already been tightened may result in a leak at the spot if the pressure is released.

In exemplary embodiments, the double impact feature makes it relatively easy to impact the backup tool on and off, as the operator can reverse the impact tool and the backup nut will tight up a little more. Impact tools have more torque in reverse than in forward such that the backup tool is easily removable from the backup nut by reversing the impact tool.

In exemplary embodiments, the backup tool's release nut is configured (e.g., offset, arranged, oriented, etc.) such that the release nut is spaced apart from the flange nut after the bolt is rotated to tighten the flanged connection and the backup tool's reaction surface is against a portion of the flanged connection. The spaced distance or gap between the release nut and the flanged connection allows a socket or other tool to access the release nut to counter-rotate the release nut and thereby release the backup tool. For example, the spaced distance or gap may be sufficiently large to allow a socket of an impact wrench to be placed onto the release nut. In exemplary embodiments, the backup tool includes a connector portion between the release nut and the arm, wherein the connector portion is sufficiently long such that the release nut does not obstruct or get in the way of the existing pipe flange nut in the on position or in the off position.

Figure 4:
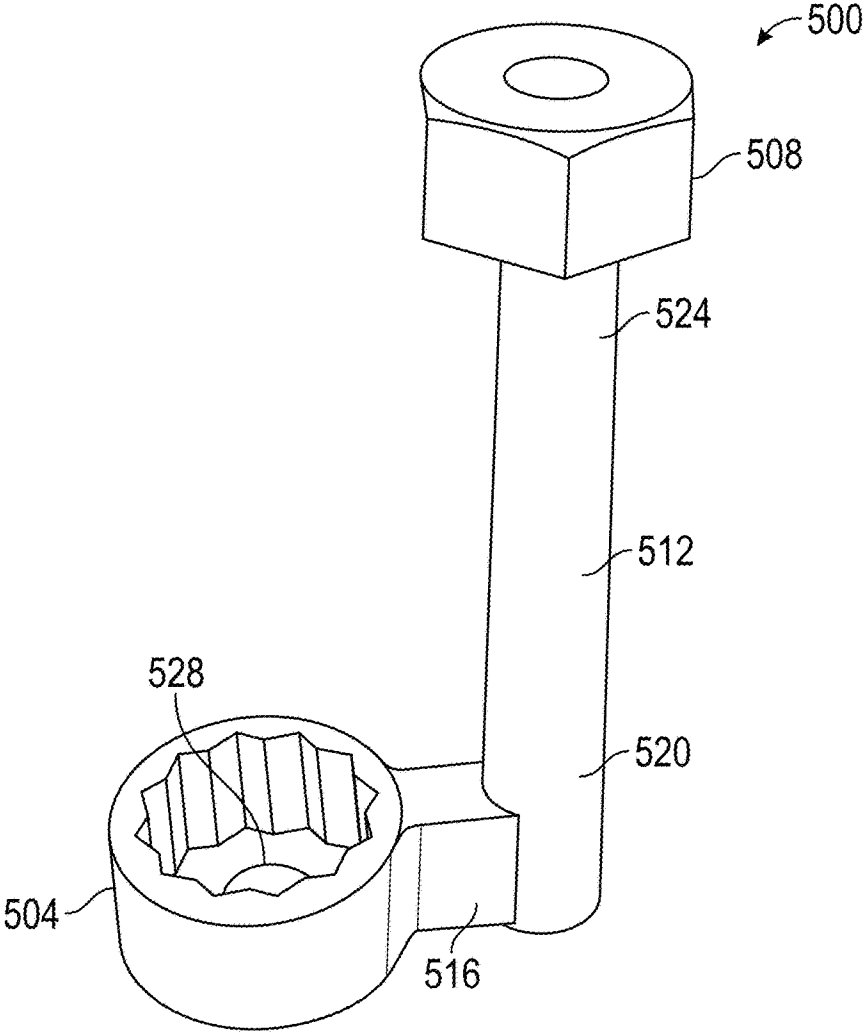

In exemplary embodiments, the backup tool is configured (e.g., shaped, dimensionally sized, etc.) such that the backup tool is positionable in at least three different positions relative to the flanged connection while the socket of the backup tool is engaged with a nut of the flanged connection. In such exemplary embodiments, the backup tool may have a sufficient swing (e.g., dimension "B" in FIGS. 4, 16 and 21, etc.) defined by a sufficiently long connector portion between the socket and the arm or handle of the backup tool. See, for example, the connector portion 516 of the backup tool 500 that extends between the socket 504 and the arm 512 as shown in FIG. 4. As also shown in FIG. 4, the socket 504 may comprise a twelve-point socket, which, in turn, provides the operator with the flexibility to install the backup tool 500 in three different positions.

In exemplary embodiments, the backup tool's release nut may also help to overcome the disadvantages associated with some conventional backup wrenches. With some conventional backup wrenches, a large torque may be applied to a bolt that generates a reaction torque at the backup wrench. This may cause the lever portion of the conventional backup wrench to become jammed onto the torque reacting adjacent nut or flange. This, in turn, may make it difficult or impossible and unsafe for the operator to overcome the force of the lever portion to remove the backup wrench from the nut.

Exemplary embodiments of the backup tools disclosed herein may eliminate the need to use magnets to retain a conventional backup wrench to a flange. As recognized by the inventor hereof, magnets may fail and/or fall off stainless steel. If the magnets fall out and/or break apart during use of a conventional backup wrench, the failure of the magnets may allow the backup wrench to dislodge and fall off the flange. The falling backup wrench may cause catastrophic injury, death, and/or damage especially when falling from significant heights. In exemplary embodiments disclosed herein, the backup tool may be horizontally retained (e.g., suspended, hung, etc.) relative to the flanged connection via the engagement of the backup tool's socket with the nut, e.g., without using magnets. The backup tool may also be vertically retained (e.g., suspended, hung, etc.) relative to the flanged connection via the engagement of the backup tool's socket with the nut e.g., without using magnets (e.g., FIGS. 22, 26, 27, and 30, etc.). The backup tools may be used with stainless steel flanged connections (e.g., stainless steel pipes and flanges, etc.), which would not be prudent for conventional backup wrenches that rely upon magnets to retain the backup wrench in place. Accordingly, exemplary embodiments of the backup tools disclosed herein may be used with various industries in which stainless steel is prevalent (e.g., FDA required, etc.), such as with beer, dairy products, medicine factories, liquids humans drink (e.g., soda, etc.), soups, acid, ammonia, and liquid fertilizer plants, bottled water plants, etc. Exemplary embodiments of the backup tools disclosed herein may be used with various industrial locations in which flanged connections are common, such as oil refineries, power plants, silo builders, gas lines, submarines, large ships, steam pipes, nuclear aircraft carriers, etc. Accordingly, exemplary embodiments of the backup tools disclosed herein should not be limited to any one particular industry or end use.

Exemplary embodiments of the backup tools disclosed herein may be used in much smaller, confined, and/or tighter spots than conventional backup tools. See, for example, Appendix A that includes FIGS. 14-27 from U.S. Provisional Patent Application No. 63/124,438 and U.S. Provisional Patent Application No. 63/125,477, which figures have been renumbered as FIGS. 22-35, respectively, in Appendix A. As explained below, FIGS. 22-35 generally show the backup tool 500 being used with differently configured flanged connections in different locations, including very tight locations, locations with height restrictions, and/or locations with obstructions (e.g., I-Beams, gear boxes, motors, elbows, etc.). The entire disclosure of Appendix A is incorporated herein by reference.

Figure 8:
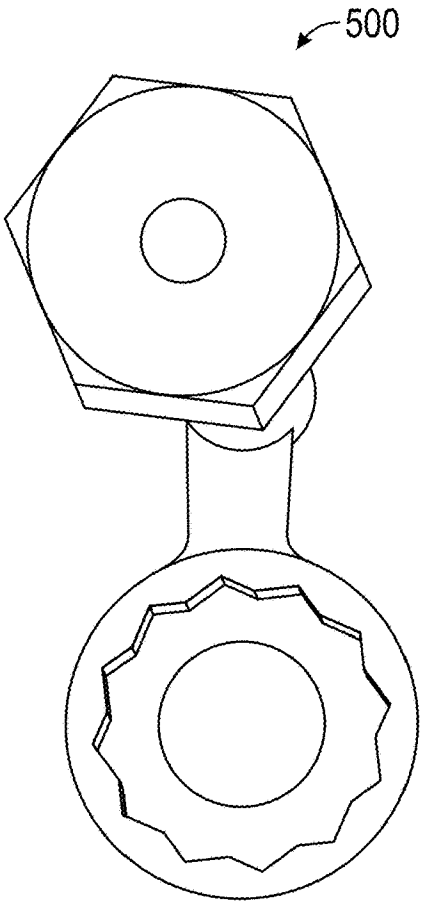
Figure 7:
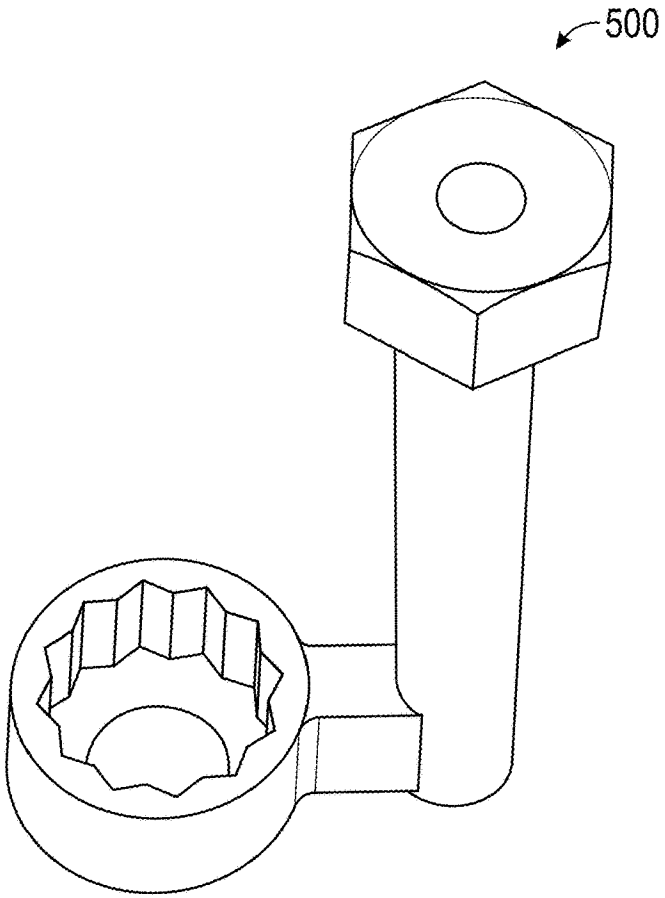
Figure 6:
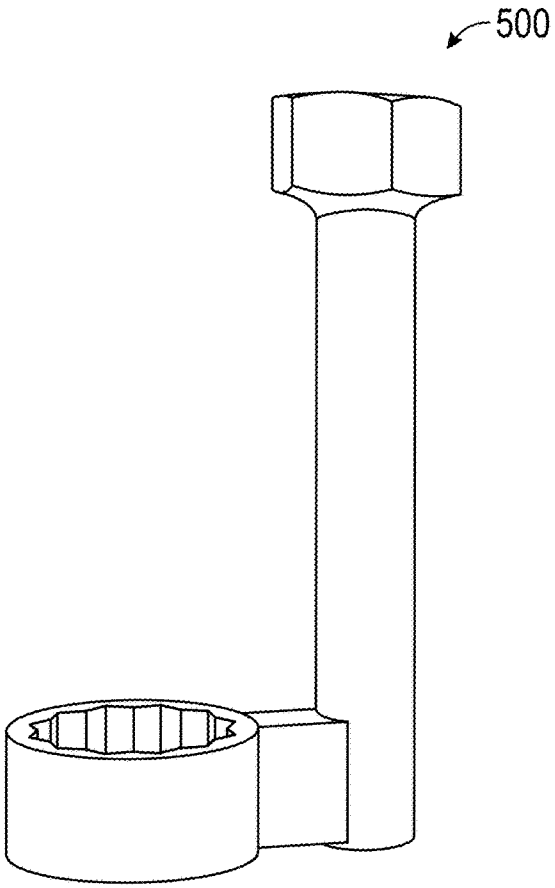

Exemplary embodiments of the backup tools disclosed herein may be used with steam lines and valves without significantly overheating and without burning the operator's hands upon removal. For example, steam lines and flanges may reach temperatures within a range from about 400 degrees Fahrenheit (° F.) to 1200° F., etc. Unlike conventional wrenches that may get too hot to handle, exemplary embodiments of the backup tools disclosed herein may remain usable with steam lines (e.g., FIGS. 26 and 27 in Appendix A, etc.) without significant overheating and remain cool enough due to their relatively long solid or hollow handles (e.g., FIGS. 7 and 8, dimensions "K" and "F" in FIGS. 16 and 21, etc.). Exemplary embodiments of the backup tools disclosed herein may be used with coal and gas power plants, e.g., the backup tools work well with long lances and with 90° elbow flanges (e.g., FIGS. 22 and 24, etc.), etc.

In exemplary embodiments, the backup tool may include a spring-loaded arm that defines the reaction surface. The spring-loaded arm may be compressible to allow the backup tool to have a shorter length as defined between the release nut and the socket that are located at opposite ends of the spring-loaded arm. By way of example, the spring(s) may be compressed to shorten the length of the backup tool to allow the backup tool to be used in more confined spaces, such as places with height restrictions, places with obstructions (e.g., elbows, I-Beams, gear boxes, motors, etc.), etc.

In exemplary embodiments, the backup tool may include a spring-loaded arm that defines the reaction surface. The spring-loaded arm may be compressible to allow the backup tool to have a shorter length as defined between the release nut and the socket that are located at opposite ends of the spring-loaded arm. By way of example, the spring(s) may be compressed to shorten the length of the backup tool to allow the backup tool to be used in more confined spaces, such as places with height restrictions, places with obstructions (e.g., elbows, I-Beams, gear boxes, motors, etc.), etc.

In exemplary embodiments, the backup tools may further include additional drive members (e.g., slide adjustable nut drives, hexagonal L-shaped wrenches, Allen wrenches, extra-long Allen sockets, etc.) such as shown in FIGS. 18A, 18B, 19, and 20, etc. In such exemplary embodiments, the backup tool's arm includes a passageway (e.g., hexagonal passageway, etc.) within an interior of the arm of the backup tool. The passageway is configured for slidably receiving an Allen portion (broadly, a shaft portion) of the drive member. The Allen portion is slidably adjustable into and out of the backup tool's passageway for slidably changing the exposed length of the Allen portion outside the passageway. This, in turn, allows the engagement portion (e.g., nut, a handle portion of a hexagonal L-shaped wrench or Allen wrench, a socket, etc.) to be slidably positionable relative to (e.g., farther away from or closer to) the backup tool. Accordingly, the Allen portion of the drive member may be positioned farther within the passageway to shorten or decrease the overall length of the backup tool and drive member. Alternatively, less of the Allen portion of the drive member may be slidably positioned within the passageway to lengthen or increase the overall length of the backup tool and drive member. In exemplary embodiments, the nut (broadly, engagement portion) of a drive member may have a different configuration (e.g., different size, smaller, larger, different shape, etc.) than or the same configuration as the release nut of the backup tool.

Figure 20:
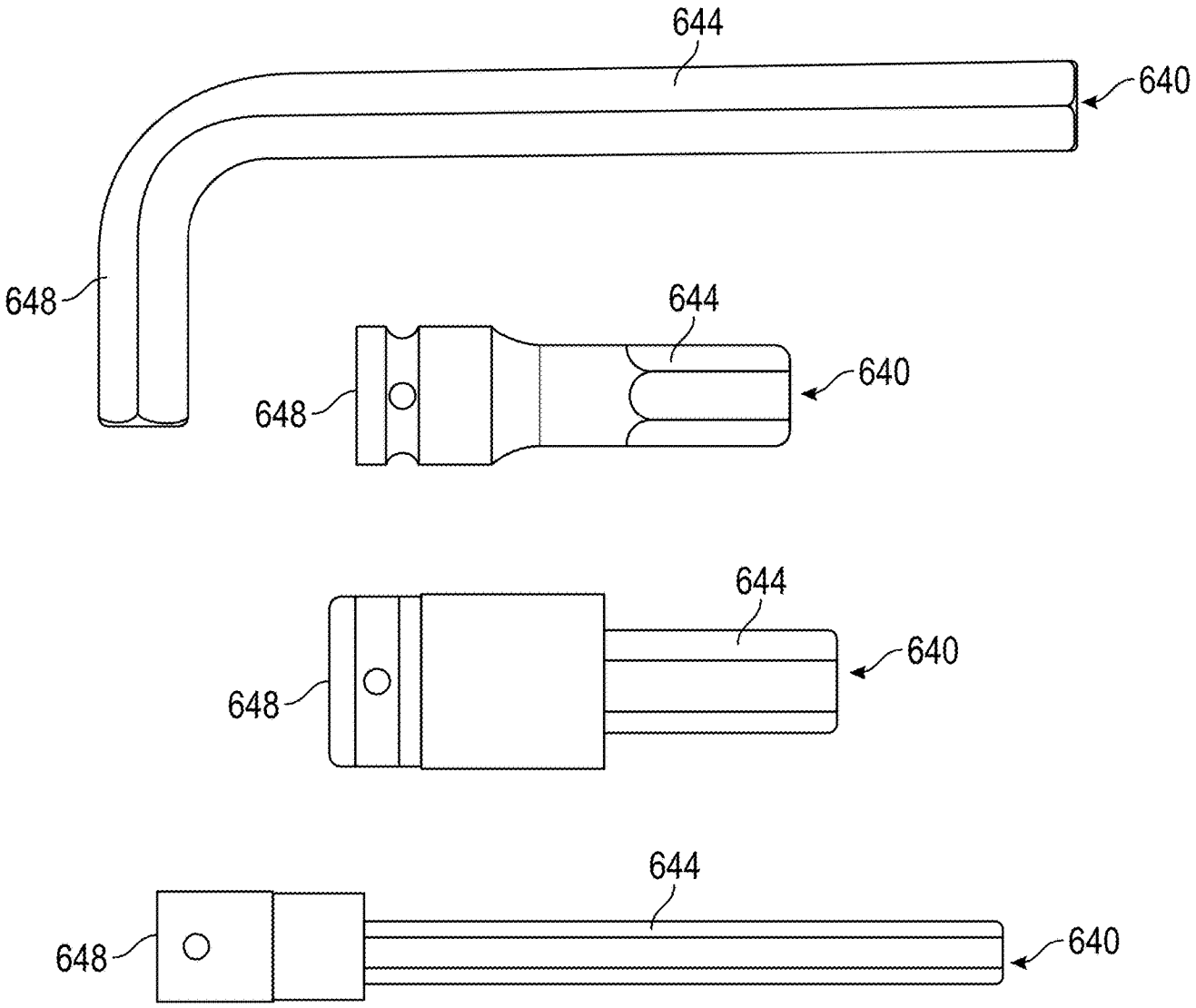

Also in exemplary embodiments, the release nut (e.g., 504 in FIG. 4, etc.) of the backup tool may be eliminated and a drive member (e.g., hexagonal L-shaped wrenches, Allen wrenches, extra-long Allen sockets as shown in FIG. 20, etc.) may be positioned within a hollow hexagonal interior of the backup tool's arm for driving the backup tool. For example, an operator may cutoff the release nut of the backup tool if necessary for a very tight spot. The operator may then slidably insert a hexagonal L-shaped wrench, Allen wrench, extra-long Allen sockets (broadly, a drive member) into the hollow hexagonal interior of the backup tool's arm, to thereby customize the backup tool for the particular task.

Figure 5:
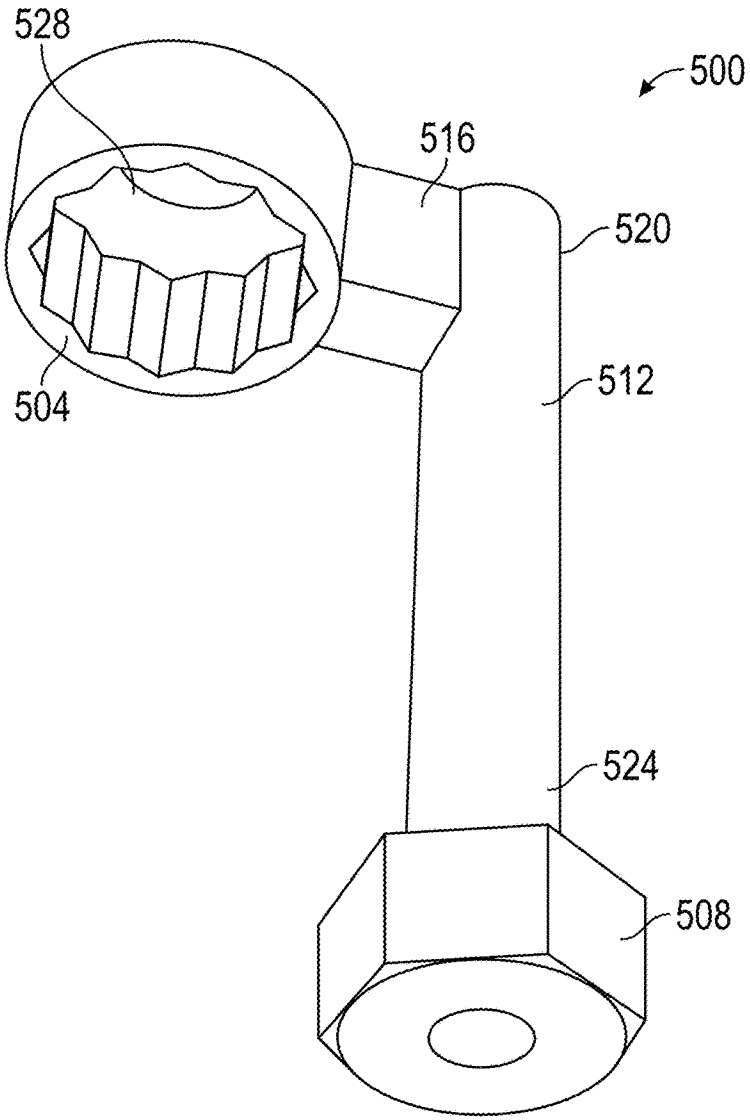

In exemplary embodiments, the backup tool may include one or more light sources (e.g., one or more light emitting diodes (LEDs), etc.) to provide illumination at a work site. For example, one or more LEDs may be disposed along or within the socket of the backup tool to help illuminate the nut or bolt head on which the backup tool's socket will be placed. As another example, one or more LEDs may be disposed along or within a hollow portion of the backup tool's reaction arm or handle (e.g., arm 512 in FIG. 5, etc.) and/or along or within the connector portion of the backup tool (e.g., backup tool connector portion 516 in FIG. 5, etc.). For underwater use, the backup tool may include one or more waterproof LEDs or other light sources. A portable flashlight may also be inserted into the hollow interior of an arm of a backup tool in an exemplary embodiment.

In exemplary embodiments, the backup tool may include a lanyard (broadly, a tether). During use, the lanyard may be attached to the operator or adjacent structure so that the backup tool remains close or in proximity to the operator, e.g., should the backup tool be accidentally dropped (e.g., from a tall building, etc.) or dislodged from the flanged connection, etc. For example, if the backup tool is being used underwater by a diver while working underwater (e.g., underwater pipe flanges of an offshore oil/gas drilling rig, etc.), the lanyard may prevent the backup tool, if dropped, from sinking to an underwater depth at which the backup tool may not be retrievable.

Exemplary embodiments of the backup tools disclosed herein may be made from various suitable materials, including stainless steels, metals, alloys, non-metals, etc. In exemplary embodiments, a backup tool may be made from zinc, 4140 stainless steel, 440 stainless steel, 316 stainless steel, or high-carbon chromium steel. The backup tool may be integrally formed (e.g., via stainless steel casting, etc.) such that the backup tool has a monolithic, single component structure including the socket, release nut, and arm.

By way of example only, the backup tool may be made from 4140 stainless steel when the backup tool will not be used underwater, e.g., in an oil refinery, power plant, etc. The backup tool may be made from zinc for a spark free worksite, e.g., when working around liquid gas, liquid propane, natural gas, gasoline pipes and flanges, hydrogen, other flammable liquids, and gases, etc. For underwater use, the backup tool may preferably be made from 316 stainless steel, such as when the backup tool will be used by a diver while working on underwater structure (e.g., underwater pipe flanges of an offshore oil/gas drilling rig, etc.), etc. In contrast, some conventional backup tools include moving parts (e.g., adjustment screws, etc.) made of metals that will rust and corrode in salt water and muddy waters leaving the moving parts inoperative.

In some exemplary embodiments, the backup tools disclosed herein do not include any moving parts (e.g., adjustment screws, etc.), which moving parts would be difficult to operate or manipulate while wearing bulky gloves (e.g., thick diving gloves worn underwater by a diver, winter gloves while working outdoors in winter, etc.). Unlike some conventional backup tools that include adjustment screws for engaging the nut within the socket or for disengaging the nut from within the socket and/or that include adjustment screws for adjusting or repositioning the reaction surface defined by the arm, exemplary embodiments of the backup tools disclosed herein do not include any adjustment screws thereby making the backup tools easier to use, which can be especially advantageous while the operator is wearing bulky gloves.

In exemplary embodiments, the arm or handle of a backup tool may be configured to have grip enhancement features to help improve the operator's grip on the backup tool. For example, the arm or handle of a backup tool may be covered, coated, or provided with elastomer to help ensure a good grip, such as a rubber coating, rubber covering, and/or rubber protrusions/tread along the arm of the backup tool. Or, for example, the arm or handle of a backup tool may have a hexagonal cross section to improve grip and make it easier to hold onto the backup tool. As another example, the arm or handle of a backup tool may be knurled (e.g., knurled stainless steel, etc.) or otherwise configured to have a textured pattern (e.g., textured pattern of crisscrossed, straight, or angled lines, etc.) to help ensure a good grip. This, in turn, may allow the operator to have a better grip on the backup tool, especially when the operator is wearing bulky gloves (e.g., thick diving gloves worn underwater by a diver, winter gloves while working outdoors in winter, etc.).

With reference to the figures, FIGS. 4-8 show an exemplary embodiment of a backup tool 500 embodying one or more aspects of the present disclosure. As shown in FIG. 4, the backup 500 generally includes a socket 504, a release nut 508, an arm or handle 512, and a connector portion 516 (e.g., right angle elbow connector, etc.). The socket 504 is disposed at or connected to a first end portion 520 of the arm 512 via the connector portion 516. The release nut 508 is disposed at a second opposite end portion 524 of the arm 512. Accordingly, the socket 504 and release nut 508 are respectively disposed at the first and second opposite end portions 520, 524 of the arm 512, such that the arm 512 extends generally between and generally perpendicularly to the release nut 508 and the socket 504.

Figure 12:
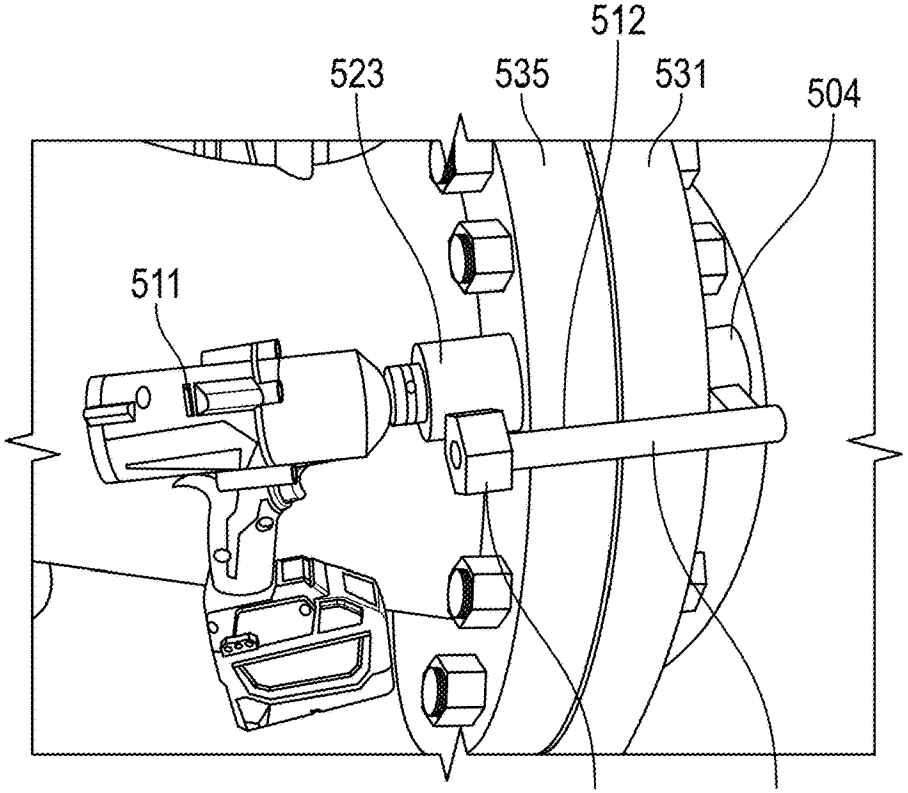
FIGS. 11-13 show an exemplary embodiment of a backup tool being used with an impact wrench for tightening a flanged connection.
Figure 11:
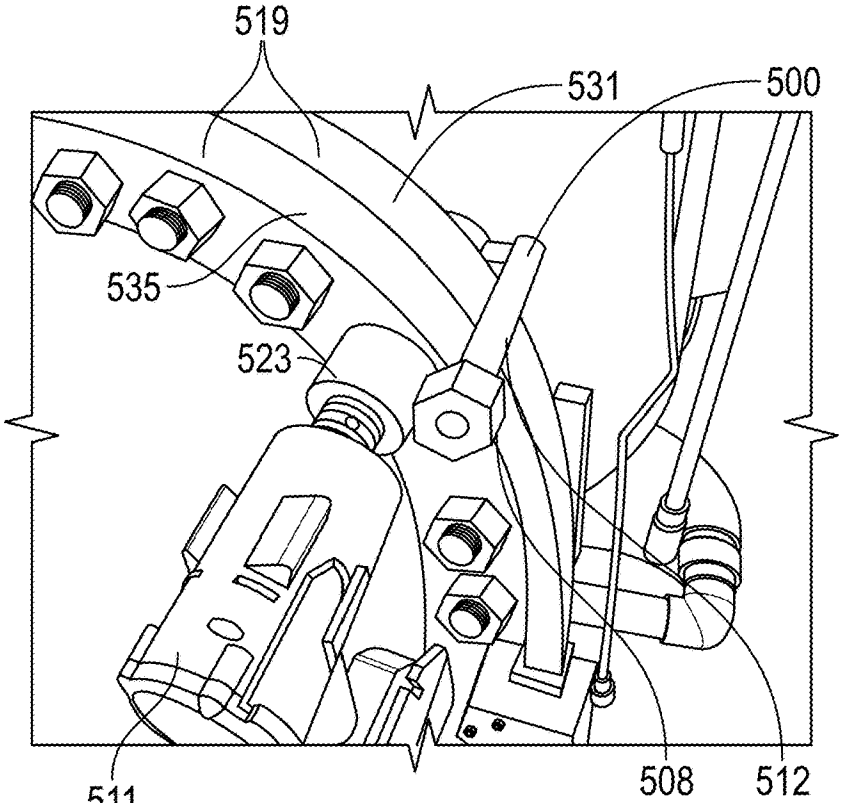
Figure 13:
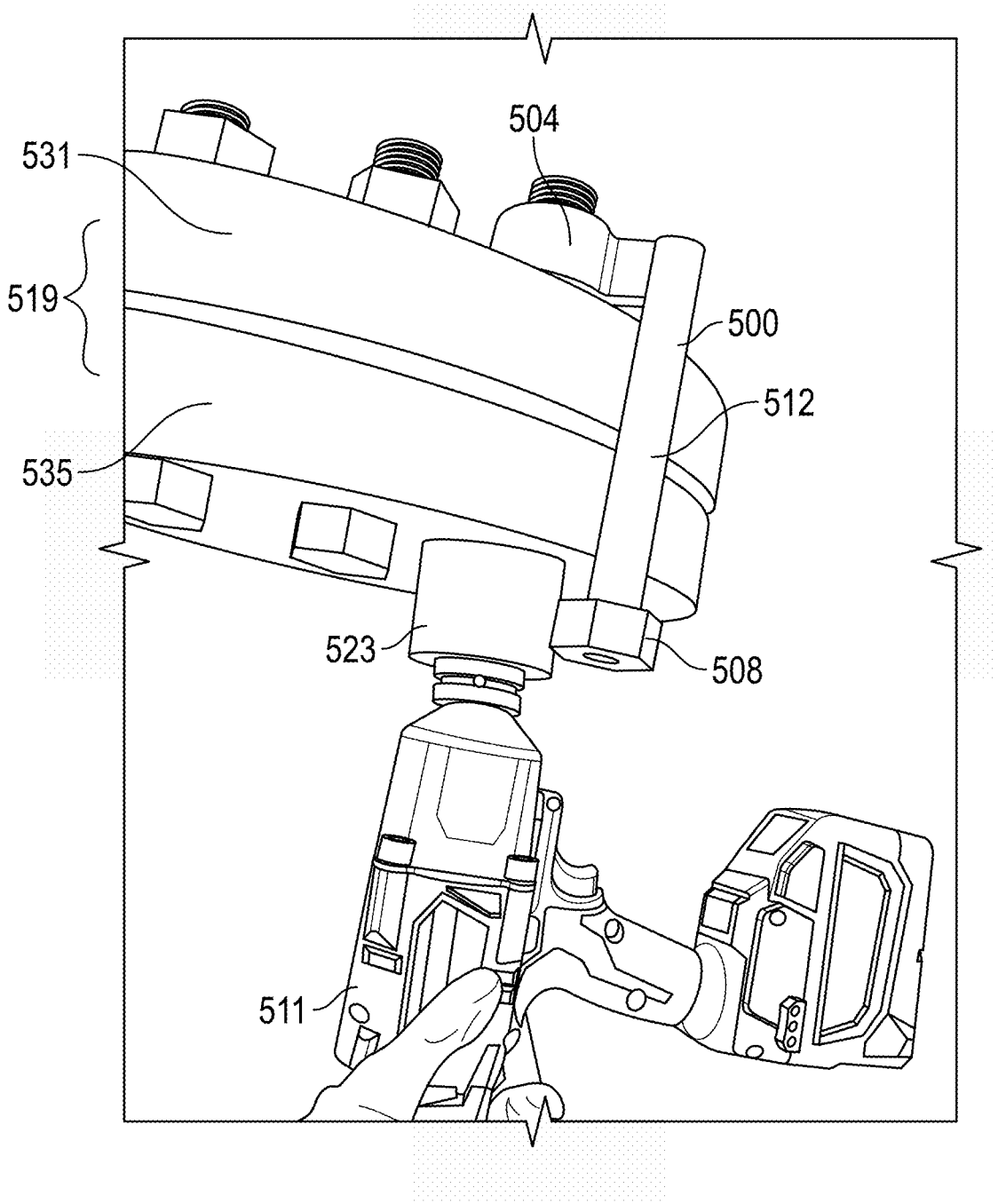

In use, the arm 512 will be generally parallel with and extend in a same general direction as a stud or bolt shank of the flanged connection 519, such as shown in FIGS. 11-13. The arm 512 extends longitudinally in a direction generally perpendicular to the clockwise or counterclockwise rotation in which the bolt or nut on the stud will be rotated to tighten the flanged connection 519. Stated differently, the arm 512 extends longitudinally in a direction generally parallel with the axis about which the bolt or nut on the stud will be rotated to tighten the flanged connection.

The socket 504 includes an opening 528 through which a threaded end portion of a bolt, stud, or rod may extend when the socket 504 is placed on and/or used to prevent rotation of a nut. See, for example, FIGS. 26 and 27 of Appendix A showing portions of a stud extending outwardly through the opening in the socket 504. The opening 528 of the socket 504 is sized to have an outer diameter sufficiently large enough to fit over the threaded end portion of a stud or bolt.

The arm 512 includes or defines a reaction surface configured to abut against at least a portion of the flanged connection (e.g., flange sidewall, etc.) to thereby prevent further rotation of a nut on a bolt or stud as the flanged connection is being tightened by rotating the bolt or another nut on the stud. See, for example, FIG. 13 showing the reaction surface of the arm 512 abutting against flanges of the flanged connection 519.

As also shown in FIGS. 13, 23, 24, and 25, the arm 512 is long enough to extend entirely across the flanged connection from the first side to the opposite second side. This, in turn, allows an operator to engage the socket 504 of the backup tool 500 with a nut along the opposite second side of the flanged connection while the operator remains on the first side of the flanged connection.

The release nut 508 is preferably configured to have a same configuration (e.g., same size, same polygonal shape, etc.) as the socket 504 and nut of the flanged socket on which the socket 504 will be placed. With reference to FIGS. 11-13, this allows a same single tool (e.g., socket 523 of impact wrench 511, etc.) to fit both the release nut 508 of the backup tool 500 and the nut of the flanged connection 519. In which case, the socket 523 (e.g., a 2-inch socket size, etc.) of the impact wrench 511 may be used for receiving and rotating a bolt head or nut (e.g., a 2-inch size bolt head or nut, etc.) of the flanged connection 519 to tighten the flanged connection 519. Thereafter, the same socket 523 of the impact wrench 511 may be used for receiving and counter-rotating the backup tool's release nut 508 (e.g., a 2-inch size nut, etc.) of the backup tool 500.

For example, the socket 523 of the impact wrench 511 may be placed onto the head of a bolt or a first nut on a stud. The bolt or first nut may be rotated using the impact wrench 511 after the socket 504 of the backup tool 500 has been placed onto a nut on the bolt or a second nut on the stud to hold the nut against rotation when the reaction surface defined by the arm 512 of the backup tool 500 abuts against at least a portion of the flanged connection (e.g., flange sidewall, etc.). After the bolt or first nut has been rotated to tighten the flanged connection, the socket 523 of the impact wrench 511 may be removed from the bolt head or first nut and placed onto the release nut 508 of the backup tool 500. The impact wrench 511 may then be used to rotate and apply torque to the release nut 508 in an opposite, counter-rotational direction in which the bolt or first nut was rotated to tighten the flanged connection 519. This counter-rotation of the release nut 508 releases the backup tool's reaction surface defined by the arm 512 while also further tightening the flanged connection 519 between the bolt and nut or between the first and second nuts from the opposite second side.

The backup tool's release nut 508 may preferably be configured (e.g., offset, arranged, oriented, etc.) such that the release nut 508 is spaced apart from the mating flanges 531, 535 after the bolt or nut has been rotated to tighten the flanged connection and the backup tool's reaction surface defined by the arm 512 is against at least a portion of the flange 531 and/or 535. The spaced distance or gap between the release nut 508 and the flanges 531, 535 allows the socket 523 of the impact wrench 511 to be placed onto the release nut 508 to counter-rotate the release nut 508 and thereby release the backup tool 500. The connector portion 516 (measurement "B" in FIGS. 16 and 21) of the backup tool 500 may have a sufficient length such that the release nut 508 does not obstruct or get in the way of the existing pipe flange nut in the on position or in the off position.

Figure 23:
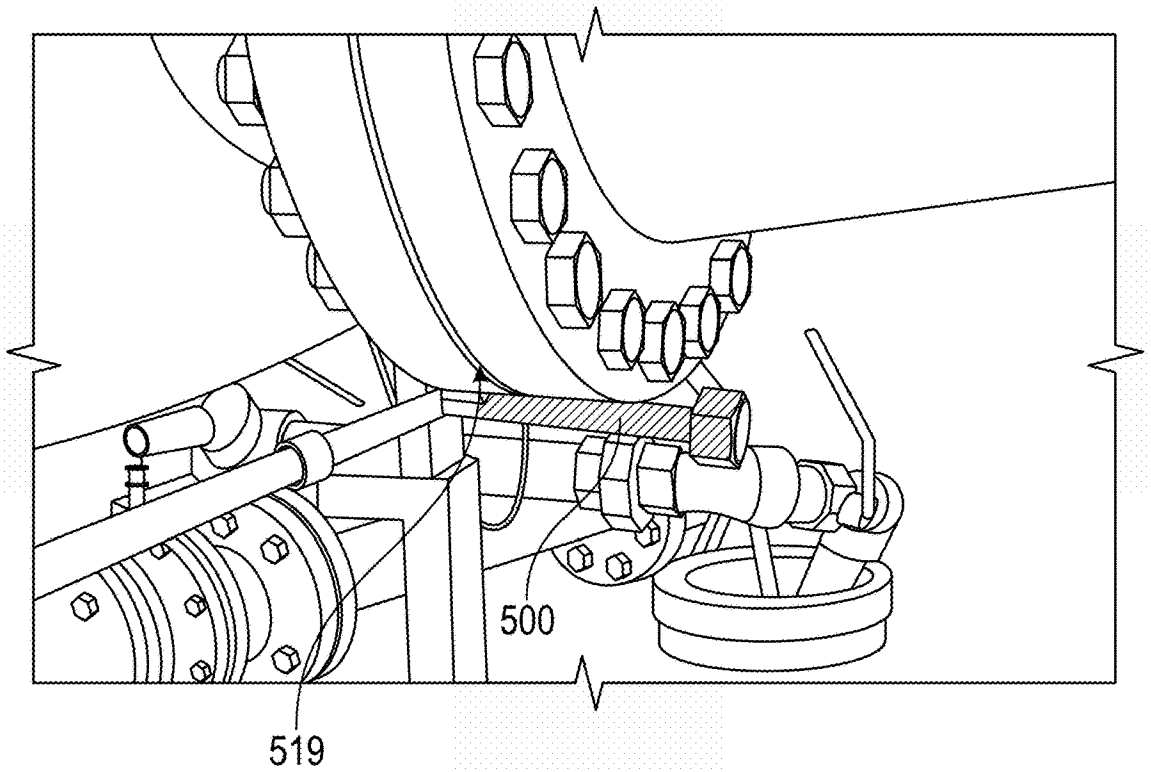
Figure 22:
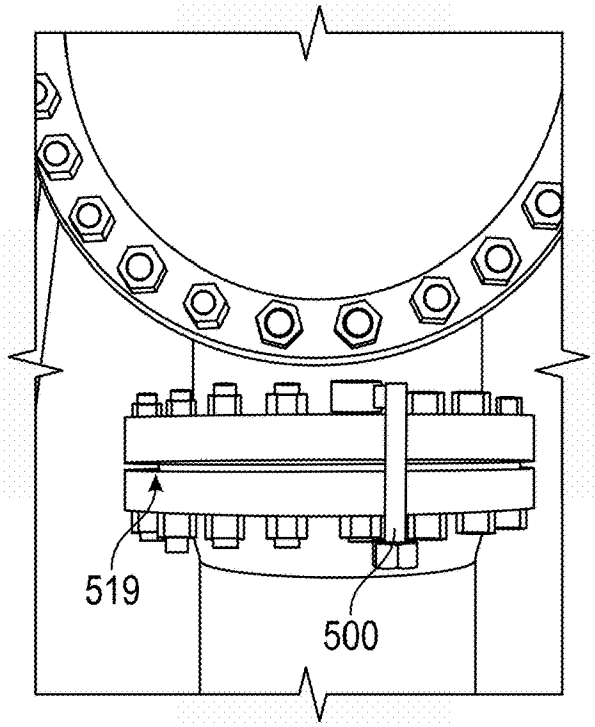
Figure 25:
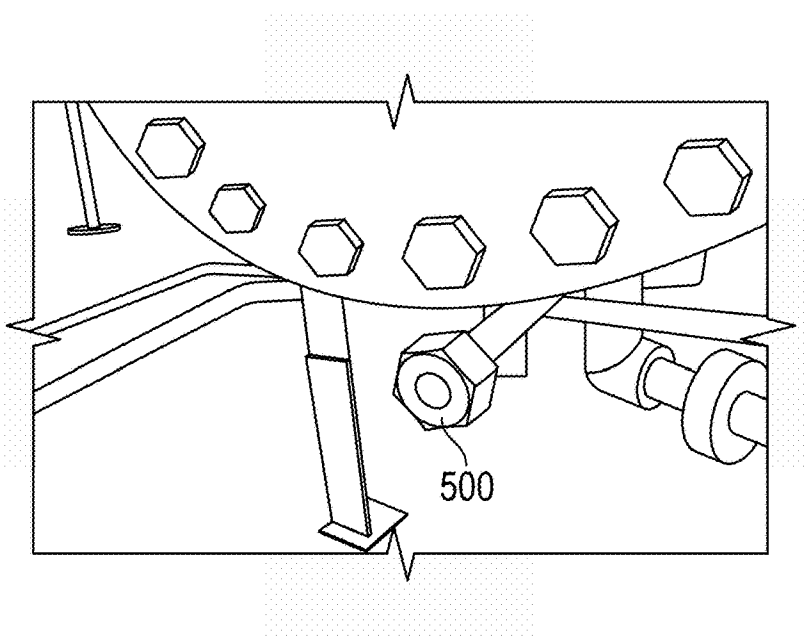
Figure 24:
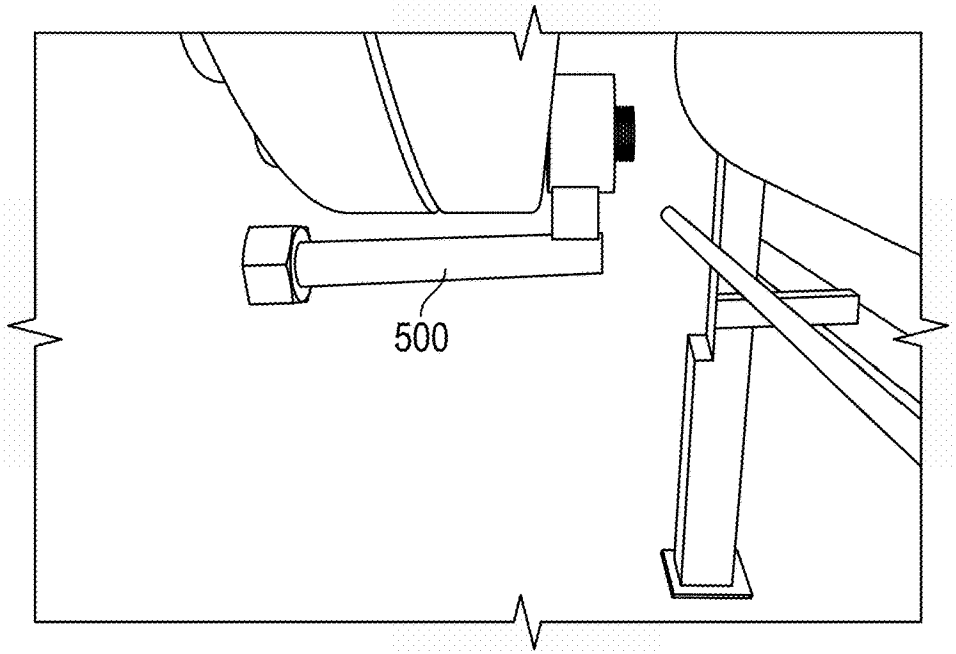
Figure 27:
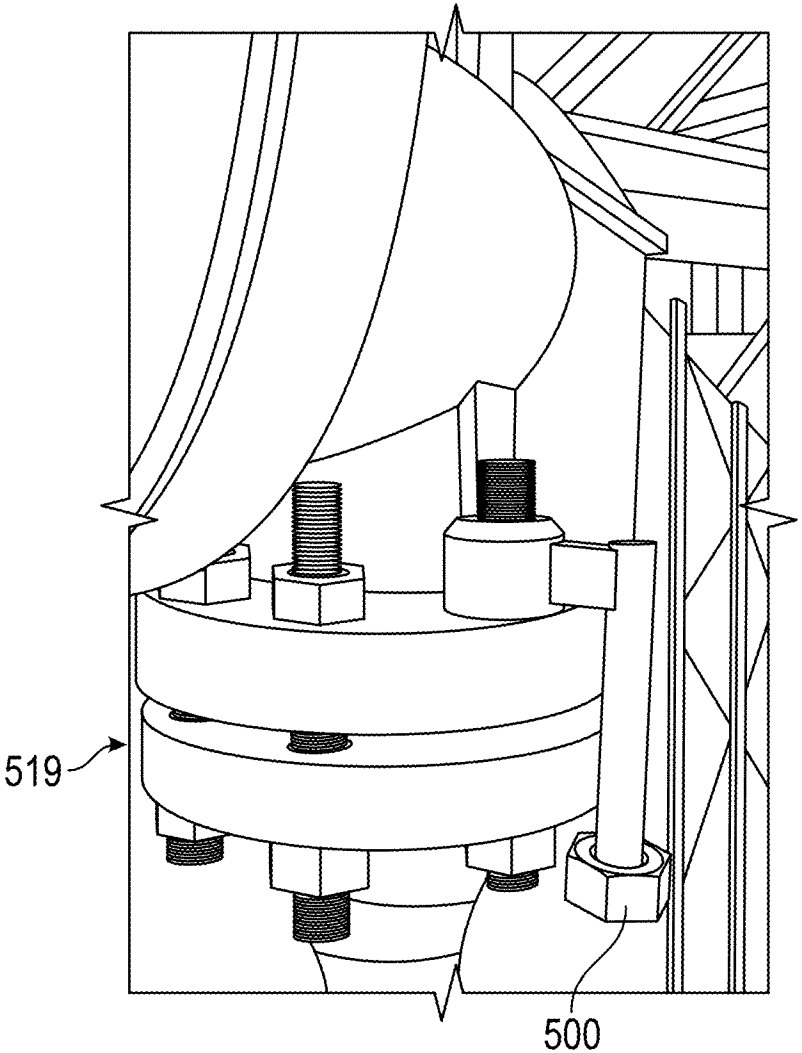
Figure 26:
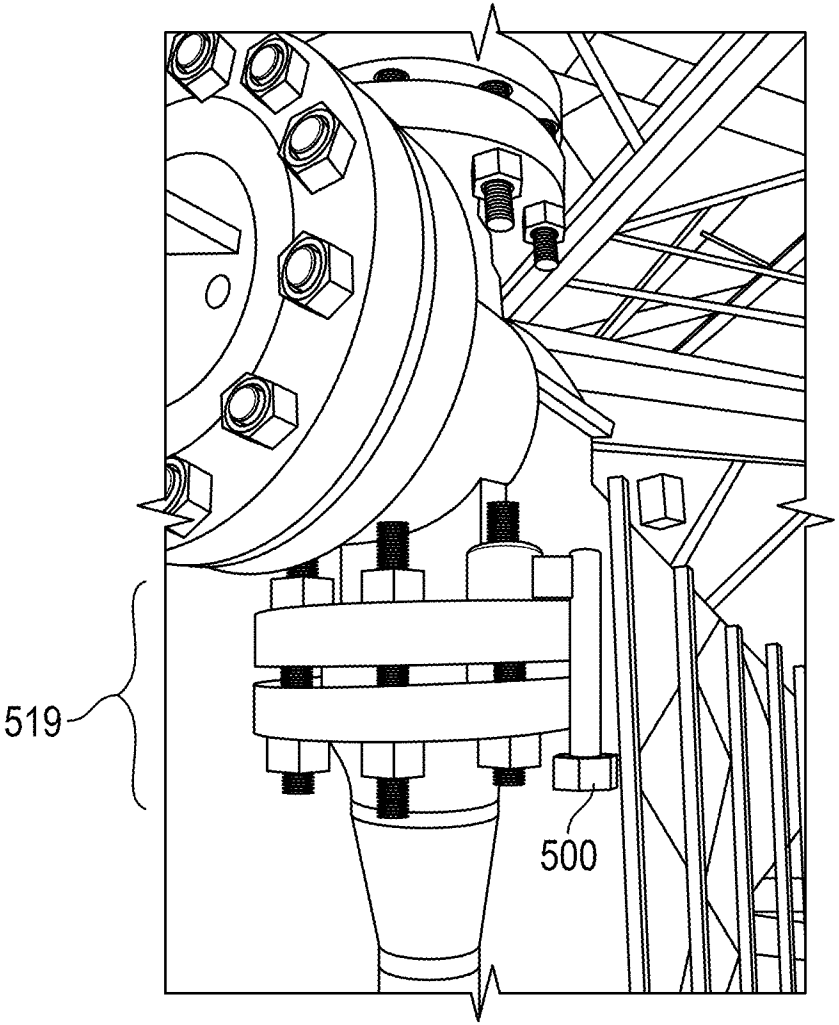
Figure 31:
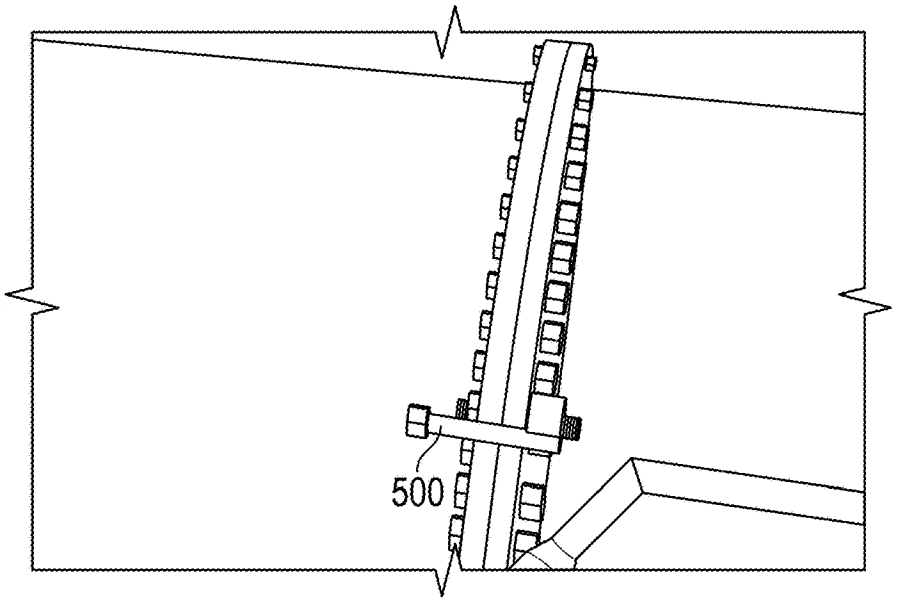

As shown by FIGS. 23, 24, and 31 of Appendix A, the backup tool 500 may be horizontally retained (e.g., suspended, hung, etc.) relative to a flanged connection 519 via the engagement of the backup tool's socket 504 with the nut, e.g., without using magnets. As shown by FIGS. 26-29 of Appendix A, the backup tool 500 may also be vertically retained (e.g., suspended, hung, etc.) relative to a flanged connection 519 via the engagement of the backup tool's socket 504 with the nut, e.g., without using magnets. The backup tool 500 may be used with stainless steel flanged connections (e.g., stainless steel pipes and flanges, etc.), which would not be prudent for conventional backup wrenches that rely upon magnets to retain the backup wrench in place.

Figure 9:
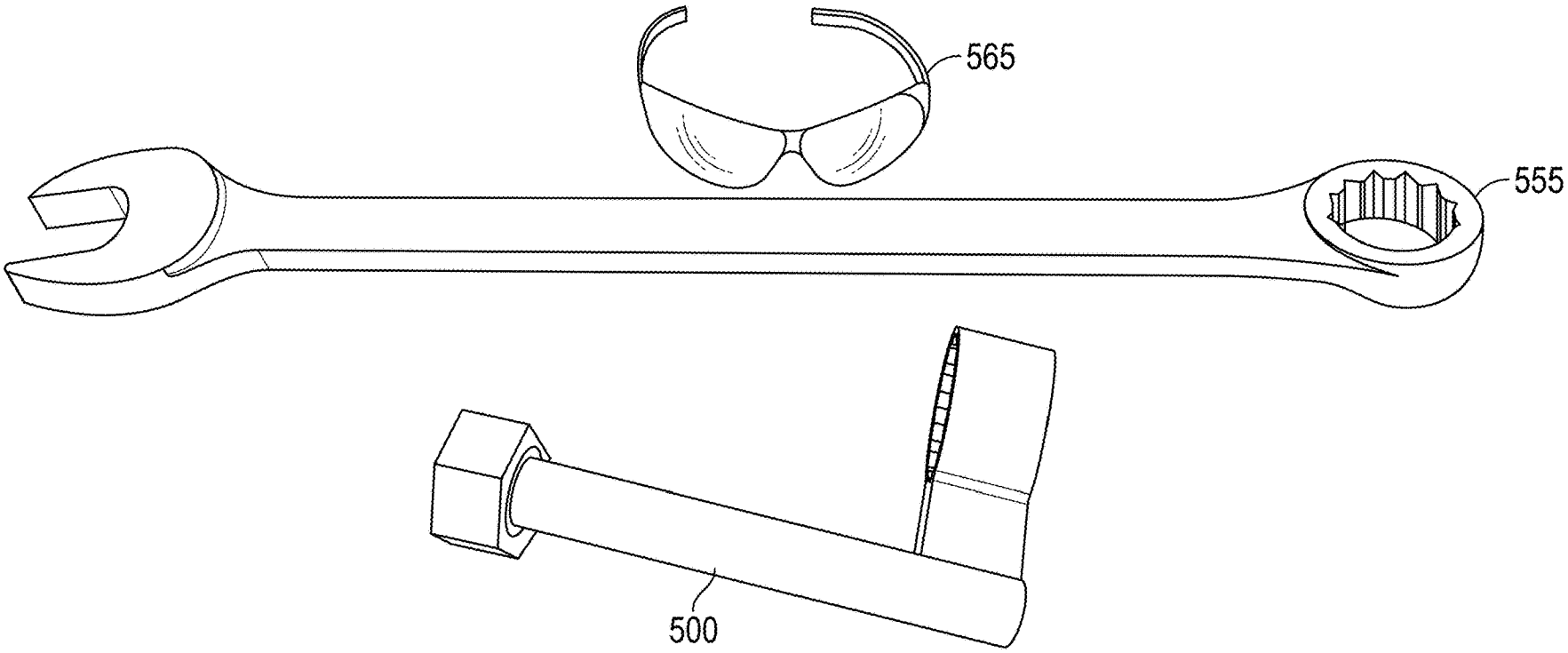
Figure 10A:
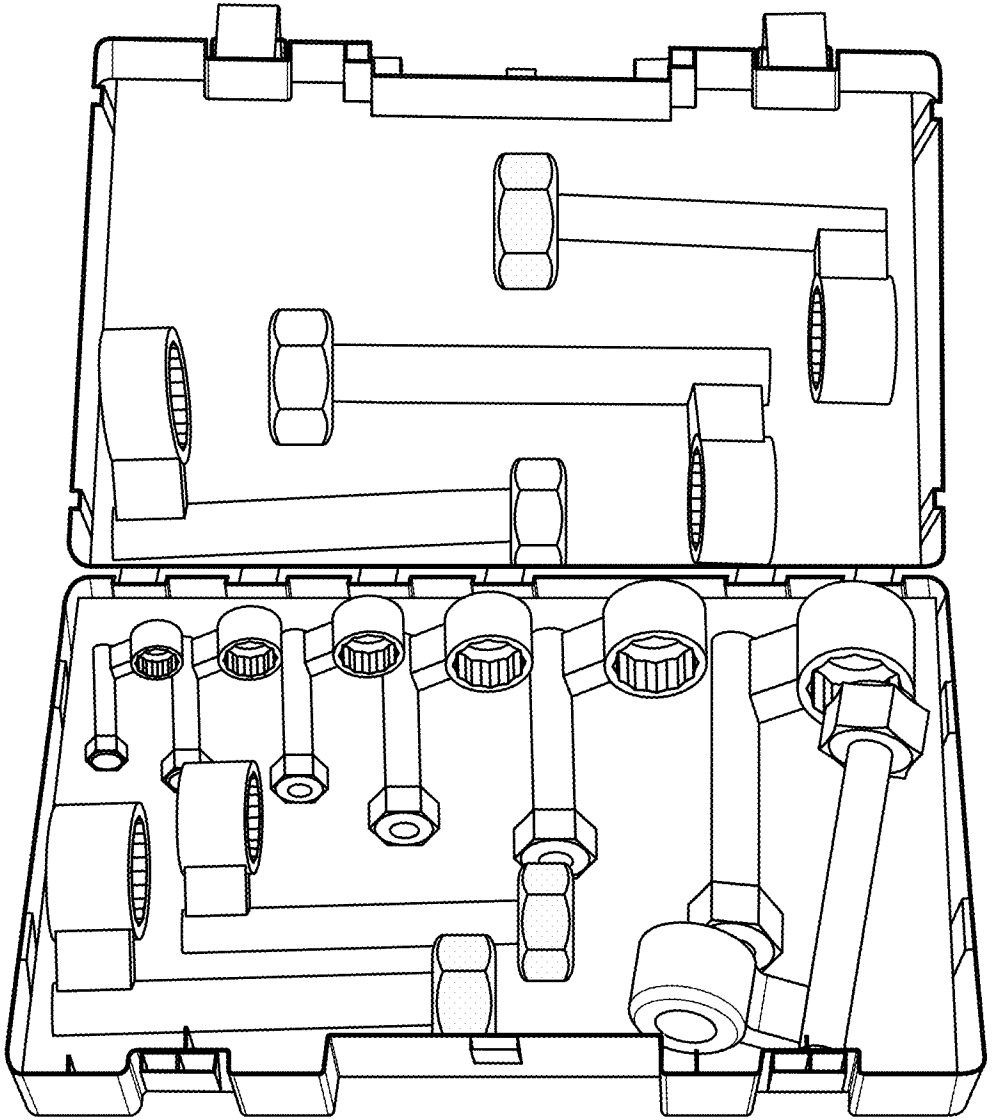
FIGS. 10A and 10B show a plurality of backup tools that have different configurations including different sizes of sockets and release nuts, arms of different lengths according to exemplary embodiments of the present disclosure.

FIG. 9 generally shows the relative sizing of the exemplary backup tool 500 along with a conventional backup wrench 555 and an adult size pair of sunglasses 565. By way of example, the 1⅞-inch backup tool 500 may weigh about 2.42 pounds, whereas the conventional 1⅞-inch backup wrench 555 may way about 6.55 pounds. The relative sizing and weights are provided for purpose of example only as the backup tool 500 may be larger or smaller in other exemplary embodiments. For example, FIGS. 10A and 10B show a plurality of backup tools that have different configurations, e.g., different sizes of sockets and release nuts, arms of different lengths, etc.

Figure 10B:
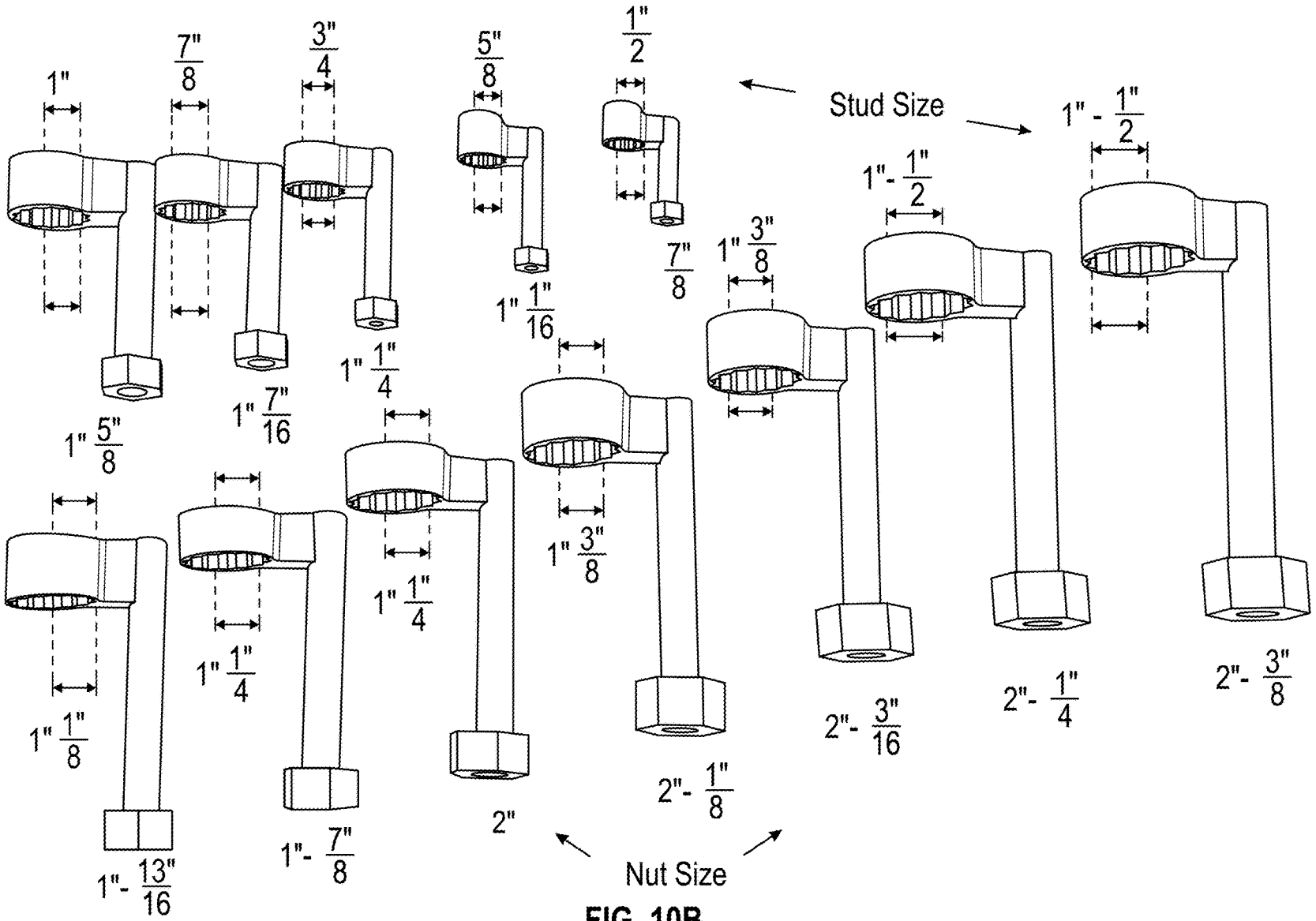

More specifically, FIG. 10B shows twelve different backup tools that are configured for use with different stud sizes and that include different socket and release nut sizes. A first backup tool may include a ⅞-inch socket and a ⅞-inch release nut and be configured for use with a ½-inch stud. A second backup tool may include a 1 1/16-inch socket and a 1 1/16-inch release nut and be configured for use with a ⅝-inch stud. A third backup tool may include a 1¼-inch socket and a 1¼-inch release nut and be configured for use with a ¾-inch stud. A fourth backup tool may include a 1 7/16-inch socket and a 1 7/16-inch release nut and be configured for use with a ⅞-inch stud. A fifth backup tool may include a 1⅝-inch socket and a 1⅝-inch release nut and be configured for use with a 1-inch stud. A sixth backup tool may include a 1 13/16-inch socket and a 1 13/16-inch release nut and be configured for use with a 1⅛-inch stud. A seventh backup tool may include a 1⅞-inch socket and a 1⅞-inch release nut and be configured for use with a 1¼-inch stud. An eighth backup tool may include a 2-inch socket and a 2-inch release nut and be configured for use with a 1¼-inch stud. A ninth backup tool may include a 2⅛-inch socket and a 2⅛-inch release nut and be configured for use with a 1⅜-inch stud. A tenth backup tool may include a 2 13/16-inch socket and a 2 13/16-inch release nut and be configured for use with a 1⅜-inch stud. An eleventh backup tool may include a 2¼-inch socket and a 2¼-inch release nut and be configured for use with a 1½-inch stud. A twelfth backup tool may include a 2⅜-inch socket and a 2⅜-inch release nut and be configured for use with a 1½-inch stud. These backup tools accommodate heavy wall nuts and thin wall nuts.

Figure 14:
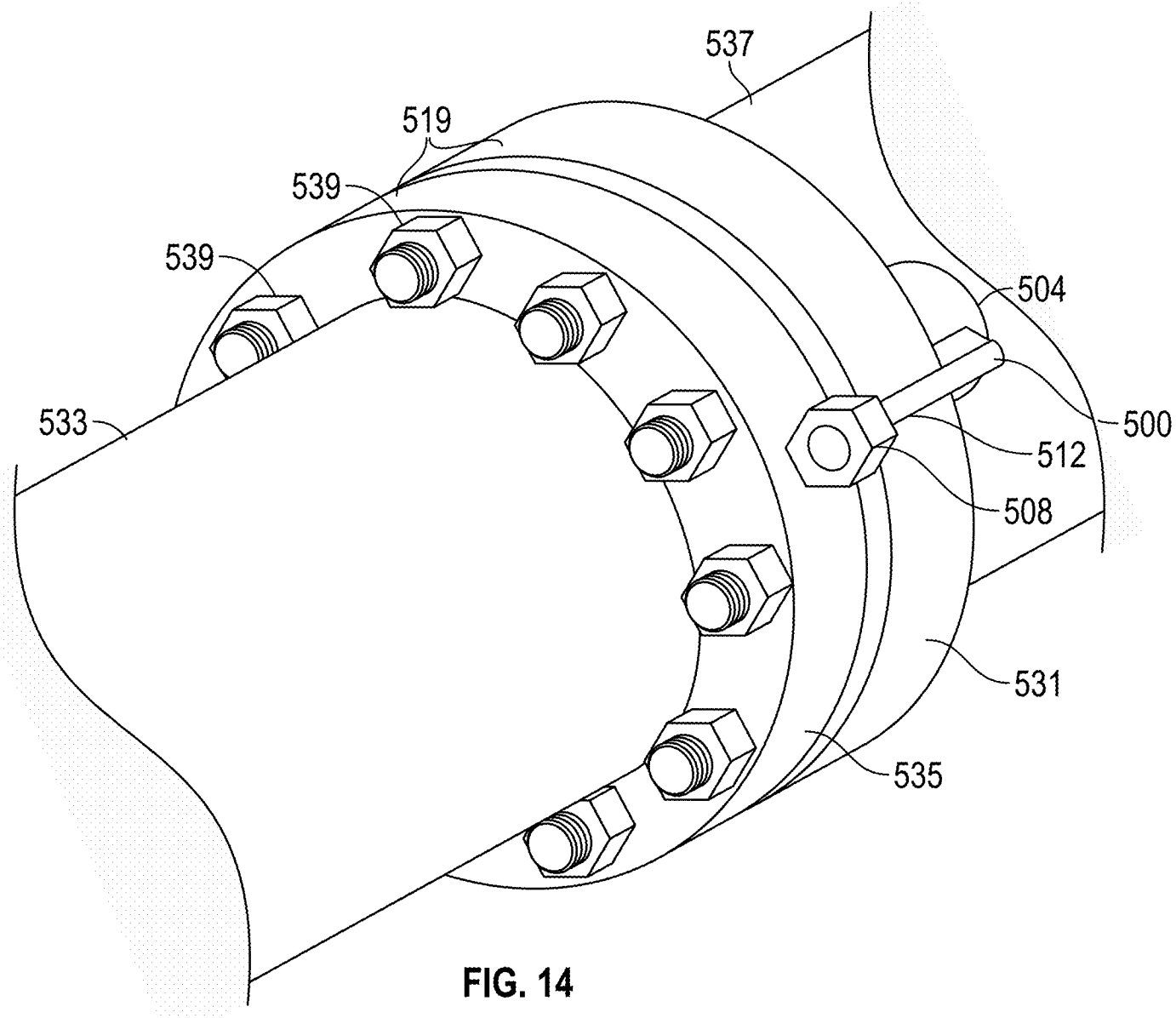
FIG. 14 shows an exemplary embodiment of a backup tool positioned along a flanged connection between two pipes.
Figure 15:
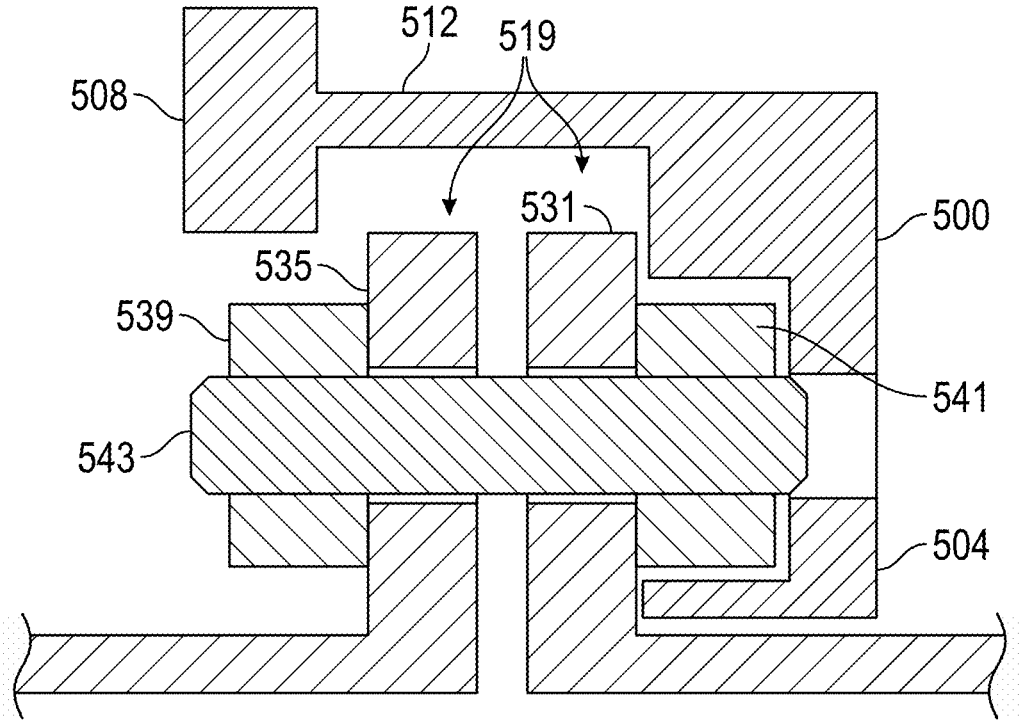
FIG. 15 is a cross-sectional view of an exemplary embodiment of a backup tool including a socket which his shown engaged with a nut of a flanged connection.

FIG. 14 shows an exemplary embodiment of a backup tool 500 positioned along a flanged connection 519 between two pipes 533 and 537. The flanged connection 519 includes flange nuts 539 along the flange 535. The socket 504 of the backup tool 500 has been positioned on one of flange nuts 541 (FIG. 15) along the flange 531 of the flanged connection 519. As shown in FIG. 15, the arm 512 is long enough to extend entirely across the flanged connection 519 from the first side defined by the first flange 531 to the opposite second side defined by the second flange 535.

With the socket 504 of the backup tool 500 positioned on the flange nut 541, a socket of an impact wrench may be placed onto the nut 539 at the opposite end of the stud 543. The nut 539 may then be rotated using the impact wrench, whereby the backup tool holds the nut 541 against rotation when the reaction surface defined by the arm 512 of the backup tool 500 abuts against at least a portion of the sidewalls of the flanges 531 and 535 of the flanged connection 519. After the nut 539 has been rotated to tighten the flanged connection 519, the socket 523 of the impact wrench 511 (FIG. 11) may be removed from the nut 539 and placed onto the release nut 508 of the backup tool 500. The impact wrench may then be used to rotate and apply torque to the release nut 508 in an opposite, counter-rotational direction in which the nut 539 was rotated to tighten the flanged connection 519. This counter-rotation of the release nut 508 releases the backup tool's reaction surface defined by the arm 512 while also further tightening the flanged connection 519 between the nuts 539 and 541 on the stud 543.

FIGS. 18A, 18B, 19, and 20 show drive members or drivers 640 that may be used with backup tools 600 according to exemplary embodiments embodying one or more aspects of the present disclosure. The backup tool 600 generally includes a socket 604, a release nut 608, an arm or handle 612 and a connector portion 616 (e.g., right angle elbow connector, etc.).

The arm 612 of the backup tool 600 includes a central passageway (e.g., passageway having a hexagonal cross section, etc.) within an interior of the arm 612. The passageway is configured for slidably receiving an Allen or hex portion 644 (broadly, a shaft portion) of the drive member 640. The Allen portion 644 is slidable into and out of the passageway defined by the arm 612 for slidably changing the exposed length of the Allen portion 644 outside the passageway. This, in turn, allows the engagement portion 648 (e.g., drive nut 648 in FIGS. 18A, 18B, and 19, Allen wrench handle 648 or socket 648 in FIG. 20, etc.) to be slidably positionable relative to (e.g., farther away from, closer to) the release nut 608 of the backup tool 600. Accordingly, the Allen portion 644 of the drive member 640 may be slidably positioned farther within the passageway of the arm 612 to shorten or decrease the overall length of the backup tool 600 and drive member 640. Alternatively, less of the Allen portion 644 of the drive member 640 may be slidably positioned within the passageway of the arm 612 to lengthen or increase the overall length of the backup tool 600 and drive member 640. In exemplary embodiments, the engagement portion 648 of the drive member 640 comprises a nut that has a different configuration (e.g., different size, smaller, larger, different shape, etc.) than or the same configuration as the release nut 608 of the backup tool 600.

FIGS. 16, 17, and 21 provide example dimensions that may be used for backup tools according to exemplary embodiments of the present disclosure. Advantageously, the inventor has discovered that with these example dimensions (e.g., "B" length of the connector portion 516, 616, etc.), the release nut (e.g., 508, 608, etc.) on the backup tool (e.g., 500, 600, etc.) does not obstruct and never gets in the way of the existing pipe flange nut in the on position or the off position. The dimension "B" shown in FIGS. 16, 17, and 21 provides sufficient offset to rotate the backup tool out of the way to provide clearance for an impact tool to access a flange nut. In addition, the backup tool may include a 12-point socket (e.g., 504, 604, etc.) that provides the operator with a fine adjustment of getting close to the flange outer diameter in both positions.

The top portion or lid of the socket (e.g., 504, 604, etc.) may be configured to be only 0.020 inches thicker than the thinnest part of the backup tool for providing maximum clearance in exemplary embodiments. The top portion or lid of the socket may include a counter bore and be rounded to a good radius for more rocker clearance.

For larger wrenches, the arm interior ("A" dimension shown in FIGS. 16, 17, and 21) may be hollow to reduce weight of the backup tool. The hollow interior of the arm may also help reduce thermal heat transfer, e.g., to allow the backup tool to remain cool enough for use when working with steam lines, etc. Schedule 80 pipe size would go through "F" and "K" measurements. The length "K" of the arm (e.g., 512, 612, etc.) may be adjustable with an internal hexagon slide in and out member. For example, the member may be slid outwardly to increase the overall length to accommodate for extra thick flanges in addition to standard 100 PSI, 300 PSI, and 600 PSI flanges. The backup tool's socket dimensions "H" and "I" shown in FIGS. 16, 17, and 21 may be shallow to allow the socket to fit into very hard to get into places, e.g., where there is no clearance above the studs in the flanges due to other mechanical devices being in the way, etc. The backup tool's socket dimension "C" shown in FIGS. 16, 17, and 21 may be configured to hold a socket on with 1/16 of an inch clearance on a side. In exemplary embodiments, the backup tool may be configured without a release nut (e.g., 508 in FIG. 4, etc.), such as when the backup tool will be used with very thick flanges (e.g., 2 feet thick, 3 feet thick flanges, etc.) or very tight spots, e.g., with less than 1 inch of clearance to get the backup tool in place.

If the impact wrench does not break the back-up tool nut loose for some reason (e.g., run out of air or hydraulics, impact wrench impact breaks down, battery power depleted, etc.), the operator may put a combination or crescent wrench on the release nut and rotate counterclockwise to break the backup tool loose. Or, for example, the operator may hit the back of the backup tool's arm with a hammer to release the backup tool.

Additionally, an operator may also spin an additional nut on the portion of the threaded stud extending outwardly beyond the backup tool's socket. The additional nut would prevent the backup tool from coming off in any condition (e.g., 100 percent safe, etc.), such as while being used in a high story building or tower, working out in the deep ocean, etc. The backup tools disclosed herein eliminates the need for two people to go out on a job. A helper is not needed to hold giant combination wrenches on the back of the flange nuts anymore. The backup tools disclosed herein can hang independently by themselves onto the nut and flange in vertical and horizontal positions. Plus, a backup disclosed herein may be much lighter and smaller than any combination wrench of its sizes. The backup tools disclosed may fit in locations at which no other wrench could go to hold a nut.

With continued reference to FIGS. 16, 17, and 21, a 37-degree angled surface starts at the "M" measurement, which angling allows the backup tool to more easily be installed on a nut. To install the backup tool, the 12-point socket is placed onto the back pipe flange nut on the side along which the operator wants to tighten or loose flange nuts. If the operator wants to loosen a nut, the backup tool is installed to the farthest left. If the operator wants to tighten a nut, the backup tool is installed to the farthest right. In exemplary embodiments, the backup tool includes a 12-point socket that provides the operator with the flexibility to install the backup tool in three different positions.

As disclosed herein, the backup tools may be configured to fit all stud nuts and bolt nuts (e.g., FIGS. 10A, and 10B etc.). The backup tools may be made for heavy wall nuts, standard size nuts, spline drive nuts, castle nuts, etc. The backup tools may fit metric studs and nuts as shown by FIGS. 10A, 10B, 16, 17, and 21. The backup tools may can be made in any size to accommodate any future nut size that arises. The backup tools may be made of 4140 steel (very hard) or 316 stainless steel to accommodate the food and drug administration. The backup tools may be made from zinc for a spark free tool, e.g., when working around liquid gas, liquid propane, natural gas, gasoline pipes and flanges, etc. 316 stainless steel would work excellent in ocean oil piping where rusting and dropping tools is a hazard, Lanyards (broadly, tethers) may be provided that are wrapped around the middle portion of the backup tool's arm (e.g., 512 (FIG. 4), 612 (FIG. 18A), dimension "K" in FIGS. 16 and 21) between the release nut and the socket. The lanyards may also be wrapped around the users' wrists or otherwise attached to the workers, to thereby ensure that the backup tools would not fall to the bottom of the ocean, fall from a high rise building or tower, etc.

APPENDIX A

As noted above, this application claims the benefit of and priority to U.S. Provisional Patent Application No. 63/124,438 and U.S. Provisional Patent Application No. 63/125,477, which are incorporated herein by reference in its entirety including its figures.

Appendix A includes FIGS. 14-27 from U.S. Provisional Patent Application No. 63/124,438 and U.S. Provisional Patent Application No. 63/125,477, which figures have been renumbered as FIGS. 22-35, respectively, in Appendix A. The entire disclosure of Appendix A is incorporated herein by reference.

FIGS. 22-35 generally show the backup tool 500 being used with differently configured flanged connections in different locations, including very tight locations, locations with height restrictions, and/or locations with obstructions (e.g., I-Beams, gear boxes, motors, elbows, etc.).

For example, FIGS. 32-35 show the backup tool 500 being used in tight spots that may not be accessible by a large conventional backup wrench 555 (FIG. 9) or other conventional tools. As shown by FIGS. 32-35, there is not enough room for conventional tools (e.g., conventional clip 10 shown in FIG. 2, conventional tool 10 shown in FIG. 3, etc.). But the backup tool 500 disclosed herein is configured to fit within the tight spot shown in FIGS. 32-35.

Figure 29:
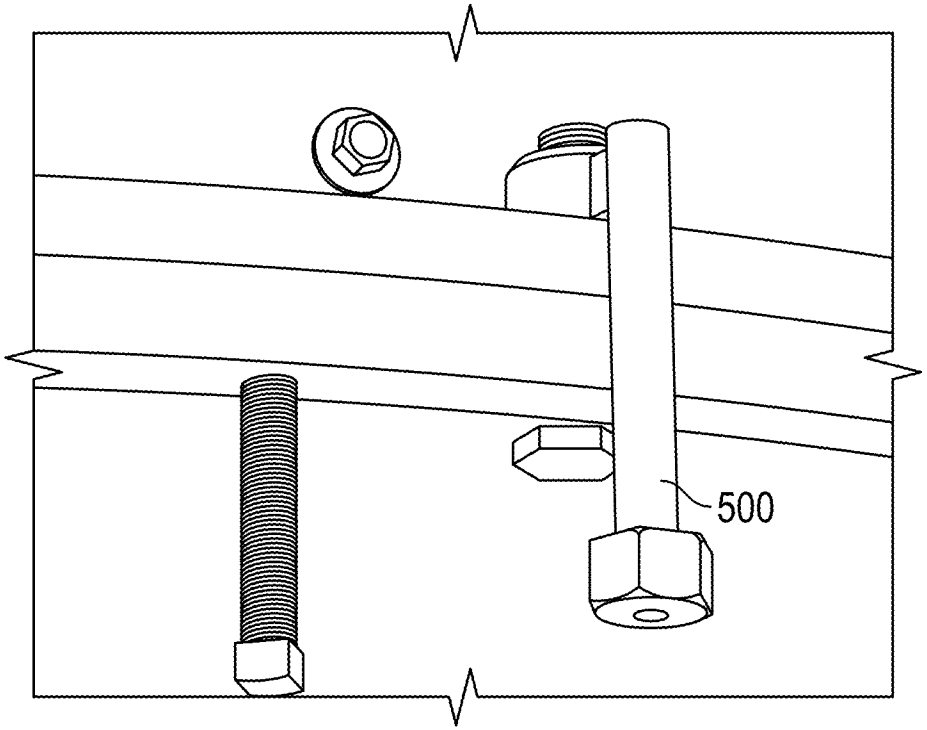
Figure 28:
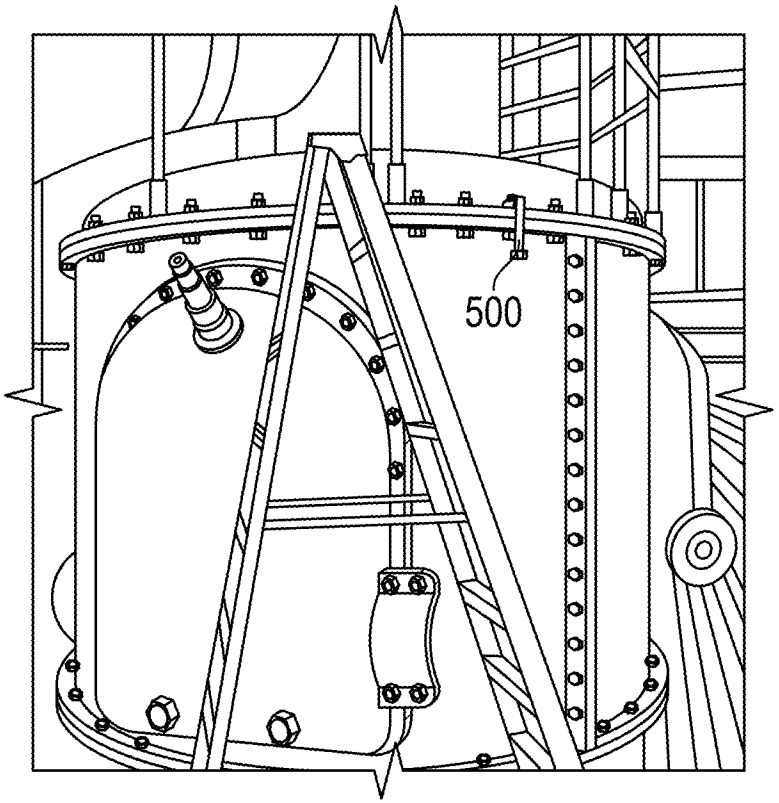

FIGS. 28 and 29 show the backup tool 500 being used at a high location accessible by ladder. Advantageously, the backup tool 500 eliminates the need to have two people up on two ladders as the backup tool 500 will be retained in place via the placement of the backup tool's socket 504 onto the nut.

Figure 30:
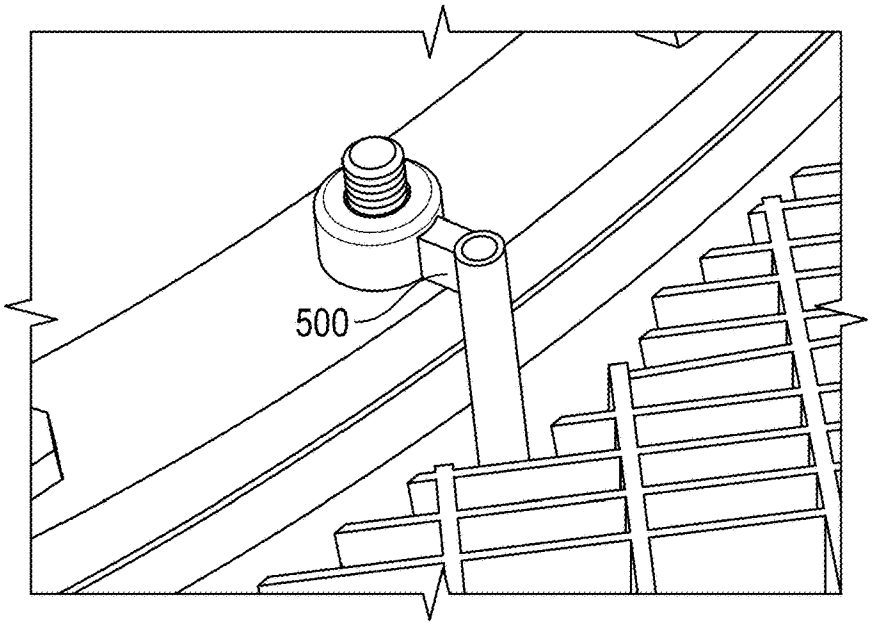
Figure 32:
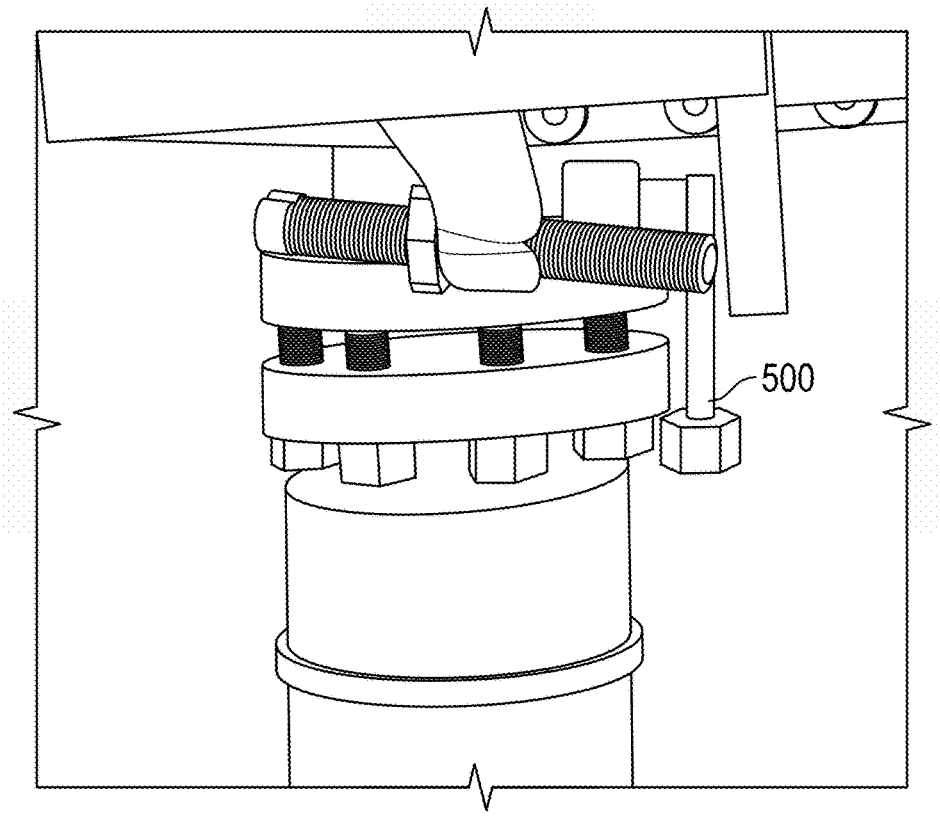
Figure 33:
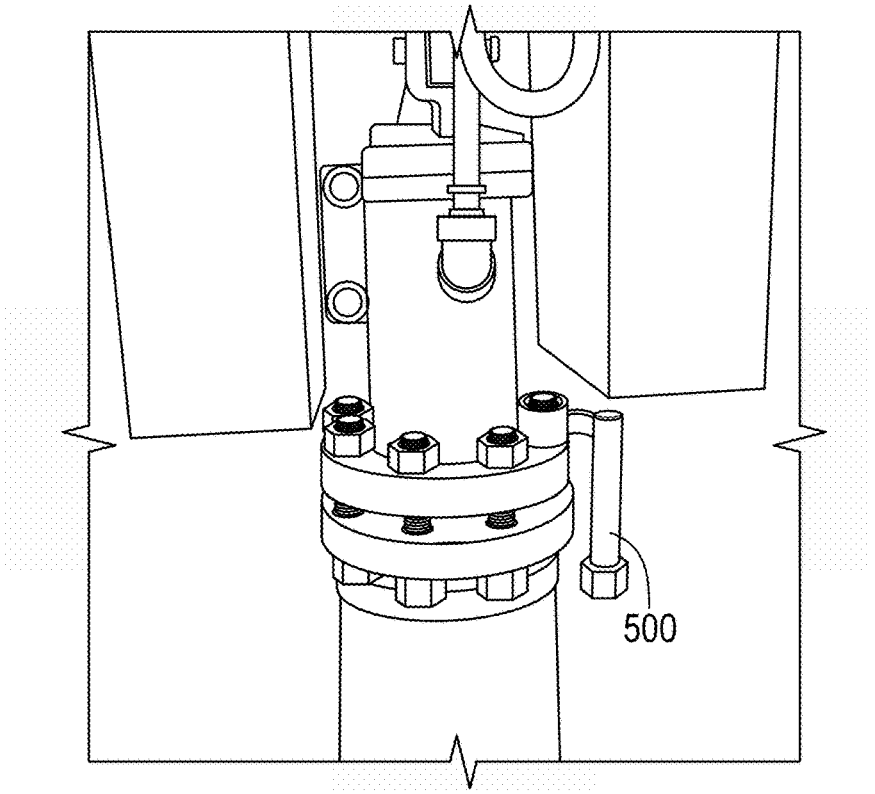
Figure 35:
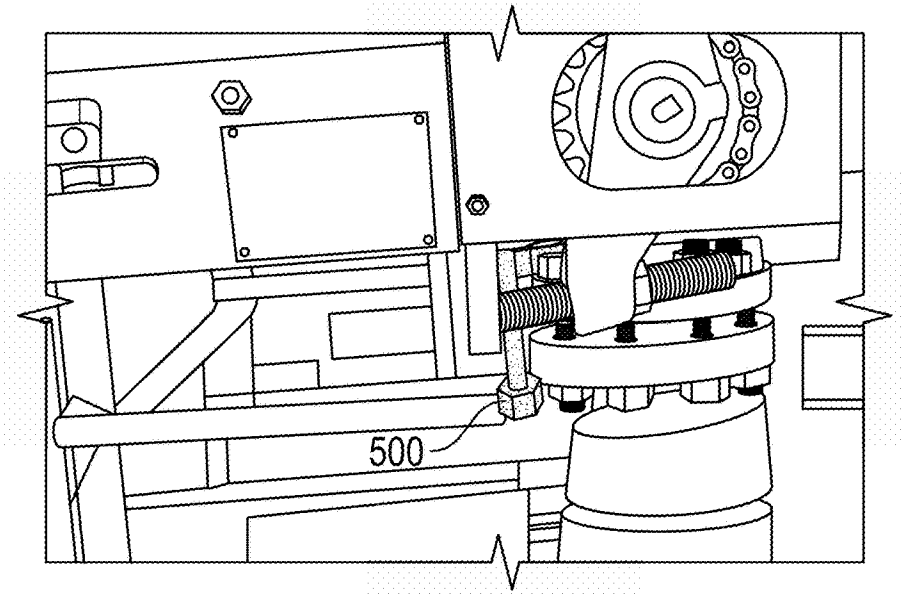
Figure 34:
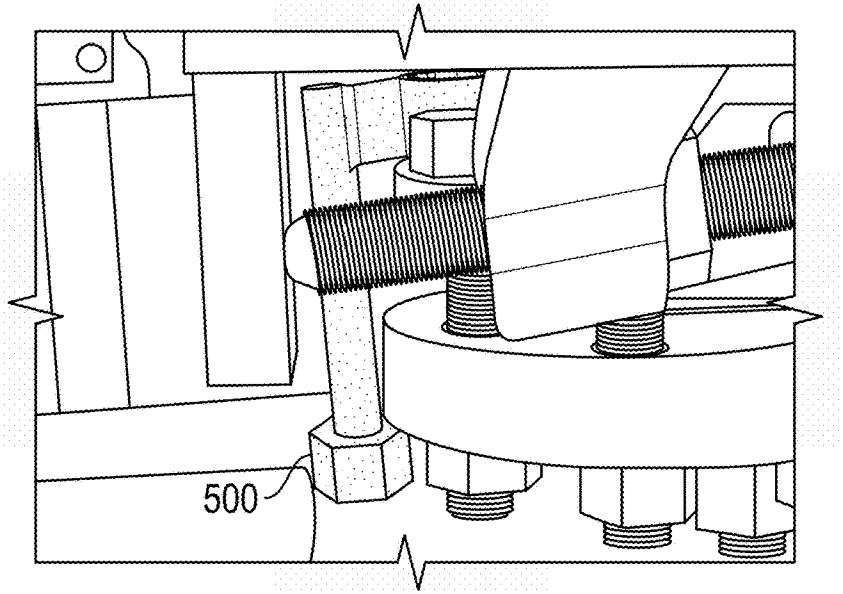

FIG. 30 shows the backup tool 500 being used across two different floors in which the backup tool's socket 504 is on an upper floor while the backup tool's release nut 508 and the impact wrench 511 would be on a lower floor. Advantageously, the backup tool 500 eliminates the need to have two people on separate floors. Also, the length of the arm 512 allows the operator to insert the backup tool's socket 504 through the opening in the floor and onto the nut above while the operator remains on the lower floor, thereby saving time. The backup tool 500 may be installed in very tight spaces needing only sufficient space for the socket diameter, e.g., to fit through a hole in a floor, fit around 90-degree elbows, fit around gauges that would otherwise be in the way, etc.

FIG. 31 shows the backup tool 500 being used along a flanged connection between pipes having diameters of five feet.

FIGS. 32-35 show the backup tool 500 being used with thirty-foot-long boiler lances. As shown, a steam valve and gearbox are obstructing and right in the way of the flange bolts and will impede or prevent a combination wrench or a ratchet/socket from accessing the bolts. At most, there may be room for a screwdriver to hold a nut but not any other conventional tool. But as shown in FIGS. 32-35, the backup tool 500 will fit in this obstructed location coming in from the top for placement of the backup tool's socket 504 on the nut.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above-mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping, or distinct) subsume all possible combination of ranges for the value that might be claimed using endpoints of the disclosed ranges.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A backup tool configured for use with an impact wrench, the backup tool comprising: a socket configured for receiving a nut of a flanged connection; a release nut; and an arm extending generally between the socket and the release nut, the arm integrally formed with the release nut, the arm defining a reaction surface configured to abut against at least a portion of the flanged connection for holding the nut of the flanged connection against rotation when the nut of the flanged connection is received within the socket and the flanged connection is being tightened by the impact wrench; wherein the release nut is configured to be receivable within a socket of the impact wrench to thereby allow the backup tool to be rotated by the impact wrench in an opposite counter-rotational direction that releases the reaction surface from abutting against the at least portion of the flanged connection while also further tightening the nut of the flanged connection.

2. The backup tool of claim 1, wherein: the backup tool includes a connector portion extending between a first end portion of the arm and the socket of the backup tool; and the release nut is at or adjacent a second opposite end portion of the arm; whereby the socket of the backup tool and the release nut are respectively at or adjacent the first end portion and the second opposite end portions of the arm such that the arm extends lengthwise generally between the release nut and the socket of the backup tool.

3. The backup tool of claim 2, wherein the connector portion is configured to have a sufficient length such that the release nut is spaced apart from and not aligned with the socket of the backup tool, whereby when the socket of the backup tool is placed on a first nut on a first end portion of a bolt or stud, the release nut does not obstruct access to a second nut on a second opposite end portion of the bolt or stud.

4. The backup tool of claim 1, wherein the socket of the backup tool comprises a twelve-point socket, whereby the backup tool is configured to allow installation of the backup tool in at least three different positions relative to the flanged connection when the nut of the flanged connection is received within the socket of the backup tool.

5. The backup tool of claim 1, wherein the backup tool is configured such that the release nut is spaced apart from the flanged connection when the reaction surface is abutting against the portion of the flanged connection, thereby allowing the release nut to be received within the socket of the impact wrench.

6. The backup tool of claim 1, wherein the socket of the backup tool, the release nut, and the nut of the flanged connection are configured to have a same size and a same polygonal shape.

7. The backup tool of claim 1, wherein the release nut and the nut of the flanged connection are configured to have a same nut size and a same polygonal shape, such that the release nut and the nut of the flanged connection are each separately receivable with the socket of the impact wrench having the same nut size and the same polygonal shape as the release nut and the nut of the flanged connection.

8. The backup tool of claim 1, wherein the backup tool is configured to be horizontally or vertically retained relative to the flanged connection via engagement of the socket of the backup tool with the nut of the flanged connection without requiring the use of magnets and without requiring another person to hold a wrench on the nut of the flanged connection.

9. The backup tool of claim 1, wherein the socket of the backup tool includes an opening to allow a threaded end portion of a bolt or stud to extend through the opening when the socket of the backup tool is placed on the nut of the flanged connection that is threadedly engaged on the threaded end portion of the bolt or stud.

10. The backup tool of claim 1, wherein the arm defines a passageway within an interior of the arm, the passageway configured for slidably receiving a shaft portion of a drive member.

11. The backup tool of claim 10, wherein:

the passageway defined by the arm includes a hexagonal cross section;

the shaft portion of the drive member includes a hexagonal cross section configured to be slidingly engaged within the passageway defined by the arm; and the drive member comprises a hexagonal L-shaped wrench, an Allen wrench, an Allen socket, or a hexagonal nut at an end portion of the shaft portion.

12. The backup tool of claim 1, wherein:

the arm is configured to be parallel with and extend in a same general direction as a stud of the flanged connection;

the arm is configured to extend longitudinally perpendicular to a clockwise or counterclockwise rotation in which the stud is rotated to tighten the flanged connection; and the arm is configured to extend longitudinally parallel with an axis of rotation about which the stud is rotated to tighten the flanged connection.

13. The backup tool of claim 1, wherein the backup tool is configured such that the socket of the backup tool will remain engaged with the nut of the flanged connection and the reaction surface will remain engaged against the portion of the flange connection without requiring a user to manually hang onto the backup tool while rotating a bolt or another nut on a stud relative to the nut of the flanged connection that is within the socket of the backup tool.

14. The backup tool of claim 1, wherein:

the backup tool does not include any adjustment screws for engaging the nut of the flanged connection within the socket of the backup tool or for disengaging the nut of the flanged connection from within the socket of the backup tool;

the backup tool does not include any adjustment screws for adjusting or repositioning the reaction surface defined by the arm; and the backup tool does not include any magnets for retaining the backup tool on the nut of the flanged connection.

15. The backup tool of claim 1, wherein the flanged connection is a bolted flanged connection comprising: first and second mating flanges respectively defining first and second sides of the bolted flanged connection; aligned bolt holes; and a bolt that extends through the aligned bolt holes of the first and second mating flanges, a bolt heat at a first end portion of the bolt along the first side defined by the first mating flange, and the nut of the flanged connection threadedly engaged on an opposite second threaded end portion of the bolt along the second side defined by the second mating flange; whereby the backup tool is operable for preventing further rotation of the nut of the flanged connection via the reaction surface abutting against the portion of the flanged connection when the nut of the flanged connection is within the socket of the backup tool and the bold is being rotated, via the impact wrench, relative to the nut of the flanged connection to thereby tighten the flanged connection white the backup tool holds the nut against rotation; or whereby the backup tool is operable for preventing further rotation of the bolt via the reaction surface abutting against the portion of the flanged connection when the bolt head is within the socket of the backup tool and the nut of the flanged connection is being rotated, via the impact wrench, relative to the bolt to thereby tighten the bolted flanged connection while the backup tool holds the bolt against rotation.

16. The backup tool of claim 15, wherein the release nut, the bolt head, and the nut of the flanged connection threadedly engaged on the opposite second threaded end portion of the bolt are configured to have a same nut size and a same polygonal shape, such that the release nit, the bolt head, and the nut of the flanged connection threadedly engaged on the opposite second threaded end portion of the bolt are each separately receivable within the socket of the impact wrench having the same nut size and the same polygonal shape.

17. The backup tool of claim 1, wherein:

the flanged connection is a studded flanged connection comprising:

first and second mating flanges respectively defining first and second sides of the studded flanged connection;

aligned holes; and a stud that extends through the aligned holes of the first and second mating flanges, a first nut threadedly engaged on a first threaded end portion of the stud along the first side defined by the first mating flange, and a second nut threadedly engaged on an opposite second threaded end portion of the stud along the second side defined by the second mating flange; and the backup tool is configured to prevent further rotation of the second nut via the reaction surface abutting against the portion of the flanged connection when the second nut is within the socket of the backup tool and the first nut is being rotated, via the impact wrench, relative to the first threaded end portion of the stud to thereby tighten the studded flanged connection while the backup tool holds the second first nut against rotation.

18. The backup tool of claim 17, wherein the release but, the first nut, and the second nut, are configured to have the same nut size and a same polygonal shape, such that the release nut, the first nut, and the second nut are each separately receivable within the socket of the impact wrench having the same nut size and the same polygonal shape.

19. A backup tool configured for use with an impact wrench, the backup tool comprising: a socket configured for receiving a nut of the flanged connection; a release nut; and an arm extending generally between the socket and the release nut, the arm integrally formed with the release nut, the arm defining a reaction surface configured to abut against at least a portion of the flanged connection for holding the nut of the flanged connection against rotation when the nut of the flanged connection is received within the socket and the flanged connection is being tightened by the impact wrench; the flanged connection comprises first and second mating flanged respectively defining first and second opposite sides of the flanged connection; and the arm is configured with a sufficient length to extend across the flanged connection from the first side to the second opposite side, thereby allowing an operator to engage the socket of the backup tool with the nut of the flanged connection and tighten the flanged connection with the impact wrench from the first or second opposite side of the flanged connection and without having to move around the flanged connection between the first and second opposite side.

20. The backup tool of claim 19, wherein the release nut is configured to be receivable within a socket of the impact wrench to thereby allow the backup tool to be rotated by the impact wrench in an opposite counter-rotational direction that releases the reaction surface while also further tightening the nut of the flanged connection.

21. A backup tool configured for use with an impact wrench, the backup tool comprising:

a socket configured for receiving a nut of a flanged connection;

a release nut; and an arm extending generally between the socket and the release nut, the arm defining a reaction surface configured to abut against at least a portion of the flanged connection for holding the nut of the flanged connection against rotation when the nut of the flanged connection is received within the socket and the flanged connection is being tightened by the impact wrench;

wherein the backup tool is integrally formed and has a monolithic, single component structure including the socket, the release nut, and the arm of the backup tool.

* * * * *